US005407038A

United States Patent [19]

Pedlar

[11] Patent Number: 5,407,038

[45] Date of Patent: Apr. 18, 1995

[54] LUGGAGE CASE

[75] Inventor: Roger Pedlar, London, England

[73] Assignee: Samsonite Corporation, Denver, Colo.

[21] Appl. No.: 70,653

[22] Filed: May 28, 1993

Related U.S. Application Data

[63] Continuation of Ser. No. 885,097 May 18, 1992, abandoned.

[30] Foreign Application Priority Data

May 20, 1991 [GB] United Kingdom ..... 9110896

[51] Int. Cl.[6] ..... A45C 13/00

[52] U.S. Cl. ..... 190/18 A; 190/107; 190/117

[58] Field of Search ..... 190/18 A, 107, 108, 190/115, 116, 117; 206/515

[56] References Cited

U.S. PATENT DOCUMENTS

| | | | |
|---|---|---|---|
| Re. 29,036 | 11/1976 | Hager . | |
| 322,239 | 7/1885 | Beckwith . | |
| D. 339,917 | 10/1993 | Pedlar . | |
| 1,020,801 | 6/1912 | Berault . | |
| 1,054,907 | 3/1913 | Cowan . | |
| 1,236,688 | 4/1918 | Lombardo . | |
| 1,559,898 | 11/1925 | Lotz . | |
| 1,653,015 | 12/1927 | Koelln . | |
| 1,817,518 | 8/1931 | Lacher . | |
| 1,875,037 | 8/1932 | Leberman . | |
| 1,878,413 | 9/1932 | Leberman . | |
| 2,041,850 | 5/1936 | Melick . | |
| 2,416,783 | 3/1947 | Vallieres . | |
| 2,611,463 | 9/1952 | Trimble et al. | 190/107 |
| 2,766,901 | 9/1953 | Sunko . | |
| 2,875,868 | 3/1959 | Powell | 190/107 |
| 2,885,070 | 5/1959 | Ondrejka . | |
| 2,886,830 | 5/1959 | Inguinta . | |
| 3,010,552 | 11/1961 | Davidson . | |
| 3,128,855 | 4/1964 | Hoffman et al. | 190/115 |
| 3,161,271 | 12/1964 | O'Neil . | |
| 3,166,367 | 1/1965 | Vincens . | |
| 3,352,389 | 11/1967 | Chubb . | |
| 3,371,757 | 3/1968 | Jamison et al. . | |
| 3,463,531 | 8/1969 | Reynaud . | |
| 3,579,804 | 5/1971 | Slan | 190/115 |
| 3,605,961 | 9/1971 | Marrion . | |
| 3,710,901 | 1/1973 | Guard et al. | 190/107 |
| 3,799,568 | 3/1974 | Hager . | |
| 3,949,445 | 4/1976 | Stevens . | |

(List continued on next page.)

FOREIGN PATENT DOCUMENTS

| | | | |
|---|---|---|---|
| 47945 | 4/1974 | Australia . | |
| 157968 | 10/1985 | European Pat. Off. . | |
| 247321 | 3/1987 | European Pat. Off. . | |
| 336802 | 4/1988 | European Pat. Off. . | |
| 372508 | 6/1990 | European Pat. Off. . | |
| 650890 | 3/1928 | France . | |
| 1433227 | 5/1965 | France . | |
| 2455442 | 5/1979 | France . | |
| 2521840 | 2/1982 | France . | |
| 447315 | 7/1927 | Germany . | |
| 175514 | 7/1953 | Germany . | |
| 2212232 | 3/1972 | Germany . | |
| 2213582 | 3/1972 | Germany . | |
| 2253024 | 7/1973 | Germany | 190/115 |
| 2461698 | 12/1974 | Germany . | |
| 2331837 | 1/1975 | Germany . | |
| 587630 | 5/1977 | Switzerland . | |
| 24086 | of 1908 | United Kingdom . | |
| 471981 | 9/1937 | United Kingdom . | |
| 1363753 | 8/1974 | United Kingdom . | |
| 2164993 | 4/1986 | United Kingdom . | |
| 2214490 | 6/1989 | United Kingdom . | |

*Primary Examiner*—Gary E. Elkins
*Attorney, Agent, or Firm*—Gregory W. O'Connor

[57] ABSTRACT

The luggage case is supplied in a pack for assembly by a customer. The pack includes a base shell 12 and a lid shell 14 nested together one within the other. The pack also includes a package containing feet and wheels for attachment to the outside of the case to support the case on the ground when it has been assembled, and hinge pins for securing the shells together. The package may be located between the shells. The pack is adapted to nest with a similar pack so that several packs can be stacked together for storage.

47 Claims, 13 Drawing Sheets

U.S. PATENT DOCUMENTS 4,026,570 5/1977 Feinberg .
4,299,313 11/1981 Null .
4,311,222 1/1982 Castanier .
4,335,896 6/1982 Koffler .
4,448,292 5/1984 Comfort .
4,503,955 3/1985 Fitzsimmons, Jr. ..... 190/107
4,550,813 11/1985 Browning ..... 190/18 A
4,561,526 12/1985 Winter .
4,576,307 3/1986 Frydenberg ..... 190/117
4,693,346 9/1987 Eversdijk .
4,712,657 12/1987 Myers .
4,719,663 1/1988 Termini .
4,744,445 5/1988 Anderson et al. ..... 190/107
4,817,237 4/1989 Murphy .
4,838,396 6/1989 Krenzel .
4,838,585 6/1989 Jondrow .
4,928,800 5/1990 Green et al. ..... 190/18 A
5,082,094 1/1992 Nechushtan ..... 190/107

LUGGAGE CASE

This is a continuation of application Ser. No. 07/885,097 filed on May 18, 1992, now abandoned.

This invention relates to luggage cases, and in particular to luggage cases having hard sides.

Luggage cases, such as suitcases, having hard sides are often preferred for carrying luggage because they offer more protection for the contents of the case than an equivalent soft-sided case.

Hard sided luggage cases are, however, quite bulky, and take up a relatively large amount of shelf space when they are displayed in shops compared with other goods that are sold at similar prices. This is especially relevant in hypermarkets and other retail outlets where goods are set out for self service by the customer because the large amount of shelf space required for suitcases may mean that it is not economical to stock them.

The space requirement for suitcases also adds to the cost of storing the suitcases in warehouses, and to the cost of transportation. It may also cause storage problems to the customer when not in use.

U.S. Pat. No. 3,010,552 describes a construction for a small lightweight travelling case for use as hand luggage. In this construction, the case is made of two identical integrally moulded halves, which are shaped to allow the case halves to be stacked telescopically. However this construction does not address the problems encountered with larger luggage cases of more substantial construction such as suitcases which usually have a hinge pin joining the two halves together, feet for standing the case on to protect the hinge, wheels and a pull-handle to enable the case to be pulled along by hand on its wheels. The presence of wheels and feet which project from the exterior of the known case prevent the case halves from being stacked telescopically as in U.S. Pat. No. 3,010,552. Further, the two halves joined by the conventional hinge pin cannot readily be assembled by the customer.

The present invention has been devised with the aim of overcoming the above problems.

According to the present invention in a first aspect there is provided a pack for constructing a self-assembly luggage case, the pack including a base shell and a lid shell for the case, the shells being nested one within the other, hinge means for connecting the base and lid shells together when the case is assembled, and ground-engaging support means for attachment to the outside of the case in the assembled condition to support the case when it is stood on the ground, the ground-engaging support means being so located in the pack as not to prevent the nesting of the shells.

With this arrangement substantial cases with wheels or feet which project from the outside of the case, and which otherwise would prevent nesting, can be supplied in pack or kit form with the shells nested so as to occupy the minimum volume.

In a preferred form the pack is adapted to nest with other identical packs. This enables the packs to be stacked easily, and in a much smaller space than conventional cases.

The ground-engaging support means may be positioned in the pack between the two nested shells, or they may be positioned inside one of the shells so as to lie between it and the other shell of an identical pack with which the pack is nested.

The present invention also relates to a novel hinge structure for attaching the shells of the case together.

FR-A-1433227 describes a case which is particularly suitable as a picnic case. The spearate shells each have narrow lugs spaced apart along the length the bottom wall, and a pin is inserted into the lugs to form a hinge. However, the pin is not secured or locked in the lugs, which means that the picnic case is not properly secure. Further, with a luggage case it would not be practical to form an elongate hinge along the whole length of the bottom wall as described in FR-A-1433227.

According to the present invention in a second aspect, there is provided a pack for a self-assembly luggage case, the pack comprising a lid shell and a base shell for the case, the shells being nested one within the other, and hinge means for attaching the shells together, the hinge means comprising at least two hinge pins each for insertion within co-operating hinge butts on the bottom wall of the case when the case is assembled, each pin having a sideways extension portion usable as a handle to enable the hinge pin to be inserted into the hinge butts by hand.

This arrangement enables a simple and easily constructable hinge to be provided for a self-assembly luggage case pack or kit.

Preferably, each hinge pin is also removable to enable the case to be dismantled, for example, for storage at home. The sideways extension can be used as a handle portion to enable the hinge pin to be pulled out from the hinge butts. The hinge pin may be L-shaped.

In a preferred form, a locating means is provided for co-operating with the hinge pin to locate the hinge pin against axial displacement when the hinge pin is inserted in the hinge. The locating means also preferably prevents the hinge pin from being removed when the case is closed.

The preferred arrangement enables a secure but simple hinge to be constructed for a self assembly case. Because the hinge pin cannot be removed when the case is closed, the case is protected from a thief who might try to break into the case by removing the hinge pins.

The present invention also provides in a third aspect a pack for a self-assembly luggage case, the pack comprising a lid shell and a base shell for the case, the shells being nested one within the other, and hinge means for attaching the shells together, the hinge means comprising at least two butt hinges on the bottom wall of the case, each butt hinge comprising a hinge pin, a first set of closely spaced hinge butts on the base shell each having a passage therethrough to receive the hinge pin, and a second set of closely spaced hinge butts on the lid shell each having a passage therethrough to receive the hinge pin, when the case is assembled, the first set of hinge butts being received in the spaces between the second set of hinge butts such that their passages together form a substantially continuous bore into which the hinge pin is inserted.

With this arrangement, the hinge joining the shells together is strong, as is required for a luggage case, and is simple and not costly to manufacture. The arrangement of the sets of hinge butts, or lugs, is particularly simpler to manufacture than a continuous hinge along the bottom of the case, when the case shells are made of moulded plastics material.

The present invention also provides in a fourth aspect, a feature in the design of the shells to enable the shells to nest together closely.

According to the fourth aspect, the present invention provides a pack for a self-assembly luggage case, the pack comprising a first shell and a second shell for the case, each shell having a peripheral wall, the pack further comprising means for fastening the shells together to assemble the case, in the pack the first shell being nested within the second shell, a region of the peripheral wall of the first shell near the rim being tapering inwardly from the rim to form a shoulder and provide clearance for nesting with the second shell.

Such a design enables the nested shells to fit more closely together than if the preripheral walls of the shells were tapered in a straight line, by providing a space for the rim of the outside nested second shell.

In a fifth aspect, the invention provides a luggage case comprising a first shell, a second shell, means for securing the shells together, and a handle strip, the handle strip extending across the top wall of the case and being fixed to the first shell at points on the top wall to define a fixed carry handle, at least one end of the handle strip being slidably attached to the first shell, the portion of the handle strip near said one end being flexible to define a raisable loop handle.

Such an arrangement is suited to a case in kit form because the arrangement provides both a fixed handle and a retractable handle for pulling the case, for example, on wheels. The arrangement is particularly suitable for integrally moulding the handle with a plastics shell.

In a preferred embodiment, the shells are formed with a recess under the fixed portion of the handle, for providing hand room to enable the handle to be gripped by hand to carry the case. The recess can be arcuately shaped.

Preferably, two catches are provided for securing the shells together, on the top wall of the case. The catches may be located at the points where the handle strip is attached to the top wall of the case. The handle strip can thus provide protection for the latches from above.

In a sixth aspect, the invention provides a pack for a self-assembly luggage case, the pack comprising a first shell and a second shell for the case, the shells being nested one within the other, and a catch for releasably fastening the shells together, the catch comprising at least one slidable catch member, the first shell being integrally formed with a track on which the catch member can slide, and the second shell being integrally formed with a catch lip, the arrangement being such that when the assembled case is closed, the catch lip is engageable by the catch member carried on the first shell to fasten the shells together.

With such an arrangement, strong and reliable catches can be provided cheaply with the case in kit form. Since the cost of the catches is not large, a relatively large number of e.g. four, catches can be provided on the case.

With the design of preferred embodiment, the catch members can be easily moulded in plastics material. The catch lips, and catch tracks can also be integrally formed by suitably moulding the shells In a further aspect, the present invention provides a pack for a self-assembly luggage case, the pack comprising a first shell and a second shell for the case, the shells being nested one within the other, and packaging retaining the first and second shells in the nested condition.

A preferred feature of the present invention is that the packs for the self-assembly luggage cases can be nested together. This enables the packs to be stacked easily, and in a much smaller space than conventional cases.

Therefore, in a further aspect, the present invention provides an assembly of packs for self-assembly luggage cases, each pack being a pack as set out in any preceding aspect of the invention, the packs being nested together to form a stack.

In a further aspect, the invention provides a pack for a self-assembly luggage case, the pack comprising a first shell and a second shell for the case, the first shell having a projecting rim and being nested within the second shell, the rim of the second shell being received in a channel in the rear of the projecting rim of the first shell.

In a further aspect the invention also provides an assembly comprising first and second packs for self-assembly luggage cases, each pack being a pack according to any preceding aspect of the invention, the first pack being nested within the second pack, and the shell of the first pack immediately adjacent the second pack having projecting rim with a channel formed in the rear of the rim, and the rim of the shell of the second pack immediately adjacent the first pack being received in the channel.

These arrangements are directed to positively locating the shells of the packs during storage or transportation of the packs. In particular, when a number of packs are nested together to form a stack, the weight of the stack can tend to cause deformation of the shells of the pack at the bottom of the stack. The above arrangement helps to prevent such deformation by locating the rims of the shells in each pack, or the rims of the shells of adjacent packs, relative to one another. With plastics shells, such deformation could cause problems such as sealing together the nested shells, or of permanent distortions in the shell walls.

In a further aspect, the present invention also provides a pack comprising a plurality of luggage cases, the pack including a plurality of base shells and a plurality of lid shells for the cases, the shells being nested one within another, and ground-engaging support means for attachment to each case in the assembled condition, to support the case when it is stood on the ground, the ground-engaging support means being located in the pack with the nested shells.

In one form of this pack, the lid shell and base shell for each case may be nested together one within the other. Alternatively the lid shell and base shell may be joined together by a hinge, and the pack contain the cases in their opened-out condition, with the cases being nested one within another, such that the hinged shells of one case lie side by side and nest respectively with the shells of an adjacent opened-out case.

An embodiment of the invention will now be described by way of example with reference to the accompanying drawings, in which.

The drawings show a suitcase 10 which is designed to be supplied with the shell halves, nested together and to be easily assembled by a person wishing to use the case. After use, the case can be dismantled for storage, and later reassembled for use.

Figure 1:
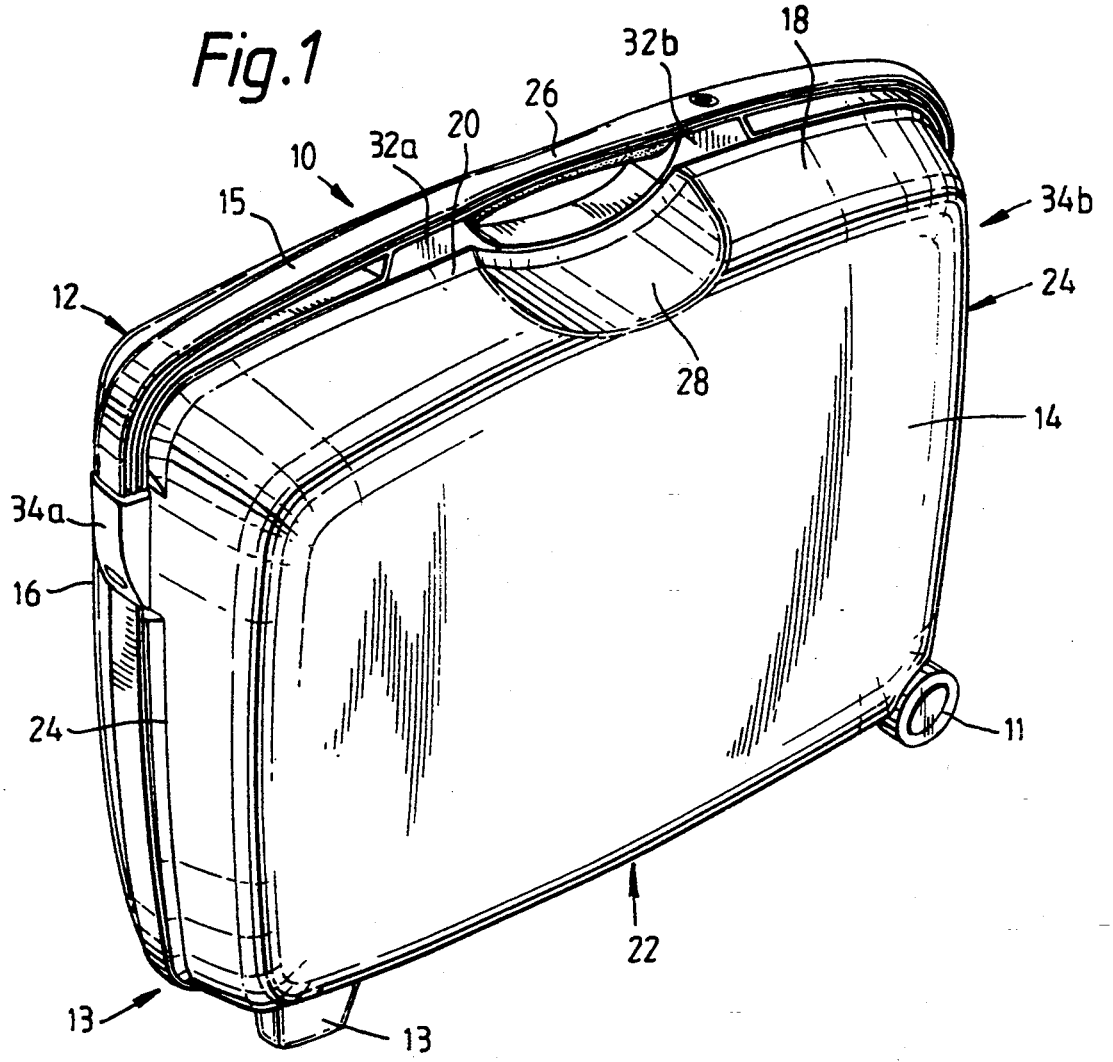
FIG. 1 is a perspective view of a self-assembly suitcase in the assembled condition.

The suitcase 10 comprises two moulded plastics shells 12 and 14. One shell 12 constitutes a base shell, and the other shell 14 constitutes a lid shell. Each shell 12, 14 has a peripheral wall 16, 18, respectively. The peripheral walls 16 and 18 together form the top wall 20, bottom wall 22, and end walls 24 of the case, as shown in FIG. 1. The base shell 12 is formed with an integrally moulded handle strip 15 along the top wall of the case. A portion of the strip forms a carry handle 26 which is spaced from the top wall 20 of the case by a short distance. An arcuate recess 28 is formed in the centre region of the top wall 20 under the carry handle 26 to provide adaquate hand clearance for a person to grasp the handle to carry the case.

A pair of wheels 11 are attached to the bottom wall 22 of the case at the corners between the bottom wall 22 and one of the end walls 24. A pair of feet are attached to the bottom wall near the corners between the bottom wall 22 and the other end wall 24.

The shells 12 and 14 are hinged together along the bottom wall 22 of the case. Four slidable catches are provided for releasably fastening the shells together when the case is closed. Two catches 32*a* and 32*b* are located on the top wall 20 of the case, and two catches 34*a* and 34*b* are located one on each end wall 24. The ends of the strip 15 that forms the handle extend over the corners between the front wall 20 and the end walls 24 and are slidably attached to housings of the side catches 34*a* and 34*b*, to form flexible loop handles for pulling or pushing the case on its wheels.

The features of the case will now be described in more detail.

Figure 2:
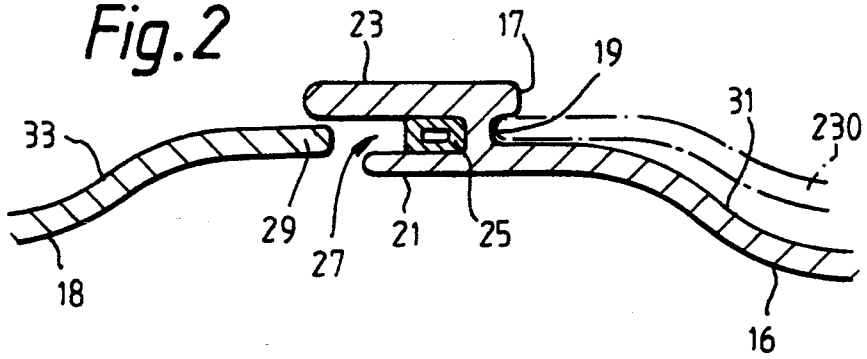
FIG. 2 is a sectional view showing the rims of the shells of the case.
Figure 3:
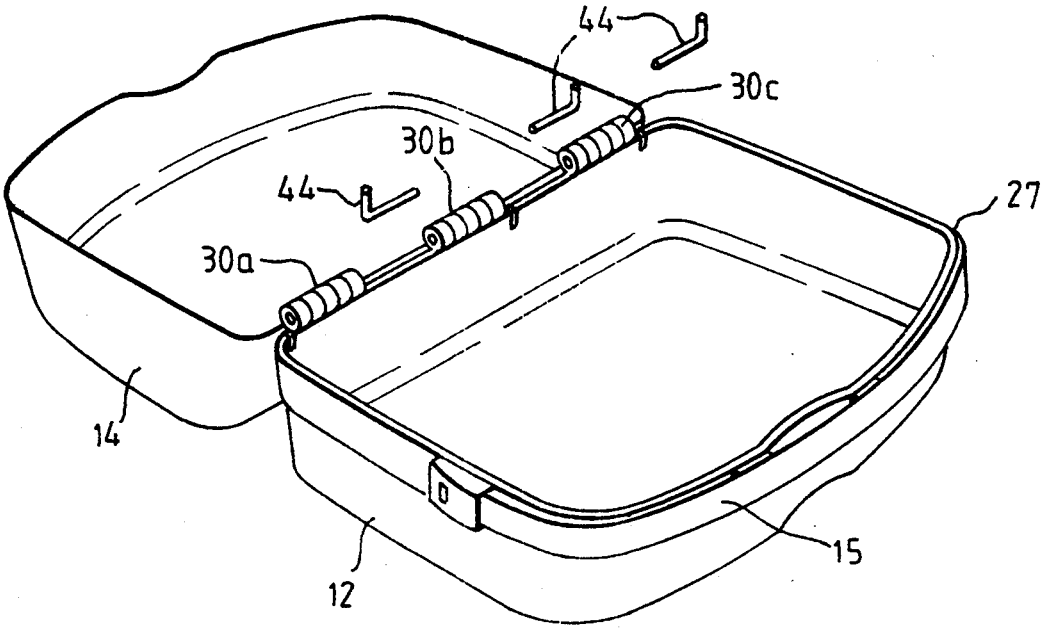
FIG. 3 is a perspective view showing the suitcase when open.

Referring to FIGS. 2 and 3, the rim of the peripheral wall of one of the shells, in this embodiment the base shell 12, is formed as an inner lip 21 and an outer lip 23 which extend side-by-side around the periphery of the shell. The outer lip 23 projects slightly above the height of the inner lip 21, and a hollow elastomeric strip 25 is located in the channel 27 between the lips 21 and 23.

When the case is being closed, the edge 29 of the peripheral side wall 18 of the lid shell 14 engages in the channel 27 between the lips 21 and 23. When the case is fully closed, the edge 29 of the lid wall 18 bears against the surface of the elastomeric strip 25, compressing it slightly. The strip 25 thus forms a weatherproof seal to prevent the ingress of water, dust and dirt into the case. The elastomeric strip 25 has a greater width than the width of the channel so that it will always be compressed when the case is closed, and the hollow design of the strip ensures that the strip can be compressed easily without damage providing a durable and reliable seal, even when the case is packed full.

The feature that the inner lip 21 projects beyond the height of the outer lip 23 means that as the case is closed, the inner lip 21 guides the edge 29 of the lid shell 14 to locate the edge 29 correctly in the channel 27 between the lips 21 and 23. This ensures that the edges of the shells mate correctly, and prevents damage or twisting of the rims which could be caused if the edges of the shells were not properly aligned when the case was closed.

The outer lip 23 on the base shell also extends downwardly to form a small lip 17 defining an exterior channel 19 facing downwardly away from the rim of the base shell 12.

As described in further detail below, a shoulder 31 is formed in the peripheral side wall 16 of the base shell 12 near its periphery, and a similar shoulder 33 is formed in the peripheral side wall 18 of the lid shell 14. The shoulders serve to increase the strength of the walls in the regions of the peripheries, and also play a part in the nesting of the cases as will be described below.

Figure 4:
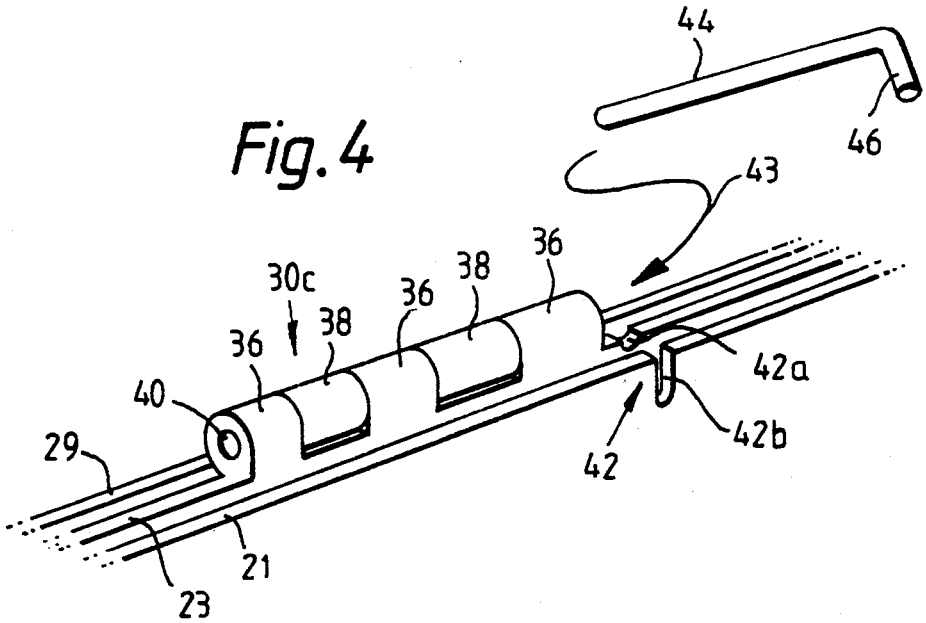
FIG. 4 is a perspective view showing the construction of one of the hinges.

Referring to FIGS. 3 and 4, the shells 12 and 14 are hinged together by three butt hinges 30*a*, 30*b* and 30*c* which are spaced apart along the bottom wall 22. Two hinges 30*a* and 30*c* are located near the corners of the bottom wall, and the other hinge 30*b* is located at the middle of the bottom wall.

The hinge 30*c* is shown in more detail in FIG. 4. It comprises two sets of lugs or butts 36 and 38 integrally moulded on the edges of the peripheral side walls 16 and 18, respectively. The lugs 36 are moulded on the edge of the outer lip 23. The lugs in each set are spaced apart such that the set of lugs 36 fit the spaces between the lugs 38. A cylindrical bore 40 passes through each of the lugs 36 and 38. A narrow slot 42 is formed in the peripheral wall of one of the shells, in this embodiment in the base shell 12, near one end of the hinge. The slot 42 is formed as a shallow slot 42*a* in the outer lip 23 and as a deeper slot 42*b* in the inner lip 21.

The lugs 36 and 38 are secured together by an L-shaped hinge pin 44. The stem of the pin 44 is inserted in the aligned bores 40, the transverse portion 46 of the pin 44 is rotated to locate the slot 42 to lock the hinge pin 44 in position. The transverse portion 46 lies under the elastomeric strip 25 and projects through the slots 42*a* and 42*b* and into the case. The transverse portion forms a tight fit in the slots 42*a* and 42*b* so that the pin 44 will not become dislodged accidentally. To assemble the hinge, the shells 12 and 14 are arranged so that the lugs 36 and 38 on the shells are in register. The stem of the hinge pin 44 is inserted into the end of the cylindrical bore 40 formed by the lugs, and pushed home. The transverse portion 46 serves as a handle to enable the pin 44 to be gripped easily and pushed into the bore 40 by hand. Once the stem has been fully inserted, the pin 44 is rotated to locate the transverse portion 46 in the slot 42. Once the hinge has been assembled, the elastomeric strip 25 can be inserted in the channel 27, to cover the transverse portion 46.

The hinge is also designed so that it can be dismantled, for example, when the case is to be stored. To dismantle the hinge, the elastomeric strip 25 is lifted out of the channel 27, the transverse portion 46 is pulled up out of the slot 42, and the pin 44 is then withdrawn from the bore 40 by using the transverse portion 46 as a handle on which to pull. Once the pin 44 has been extracted, the sets of lugs 36 and 38 can be separated.

The design of the slots 42*a* and 42*b* is such that the pin 44 cannot be removed from the hinge 30*c* unless the case is open. When the case is closed, the edge 29 of the lid shell wall 18 engages between the inner and outer lips 21 and 23, respectively, of the base shell 12, thereby preventing the transverse portion 46 of the pin 44 from being lifted out of the slot. The stem of the hinge pin 44 is therefore fixed axially within the cylindrical bore 40 of the hinge. This provides an added security feature in that, although the hinge is designed to be easily dismantled, the hinge parts cannot be separated unless the case has already been opened. The case is thus protected from a thief who might try to break into the case by removing the hinge pins.

The construction and assembly of the other hinges 30*a* and 30*b* is similar to that described above for the hinge 30*a*.

In particular, each hinge includes a respective L-shaped hinge pin 44, and a respective slot 42 for locking the hinge pin in position.

Referring to FIGS. 5 to 10, the plastics strip 15 integrally moulded with the base shell 12 is in the form of two closely-spaced parallel flanges 50 and 52 connected by a central web 54. The handle is formed in this way to provide a generally uniform wall thickness in the moulding so as to reduce the amount of plastic material required, whilst providing a handle of sufficient strength. The strip 15 is joined to the outer lip of the base shell 12 by two webs 62*a* and 62*b* located one at each end of the arcuate hand recess 28. The portion of the strip extending between the webs 62*a* and 62*b* forms the carry handle 26. On this portion, a narrower third flange 56 is carried by the central web 54 below the two flanges 50 and 52. The third flange 56 carries a rubber strip 58 of generally U-shaped cross section, which fits against the underside of the carry handle 26. The sides of the rubber strip 58 have turned-in lips 60 which fit over the third flange 56 to hold the rubber strip 58 in position.

Figure 5:
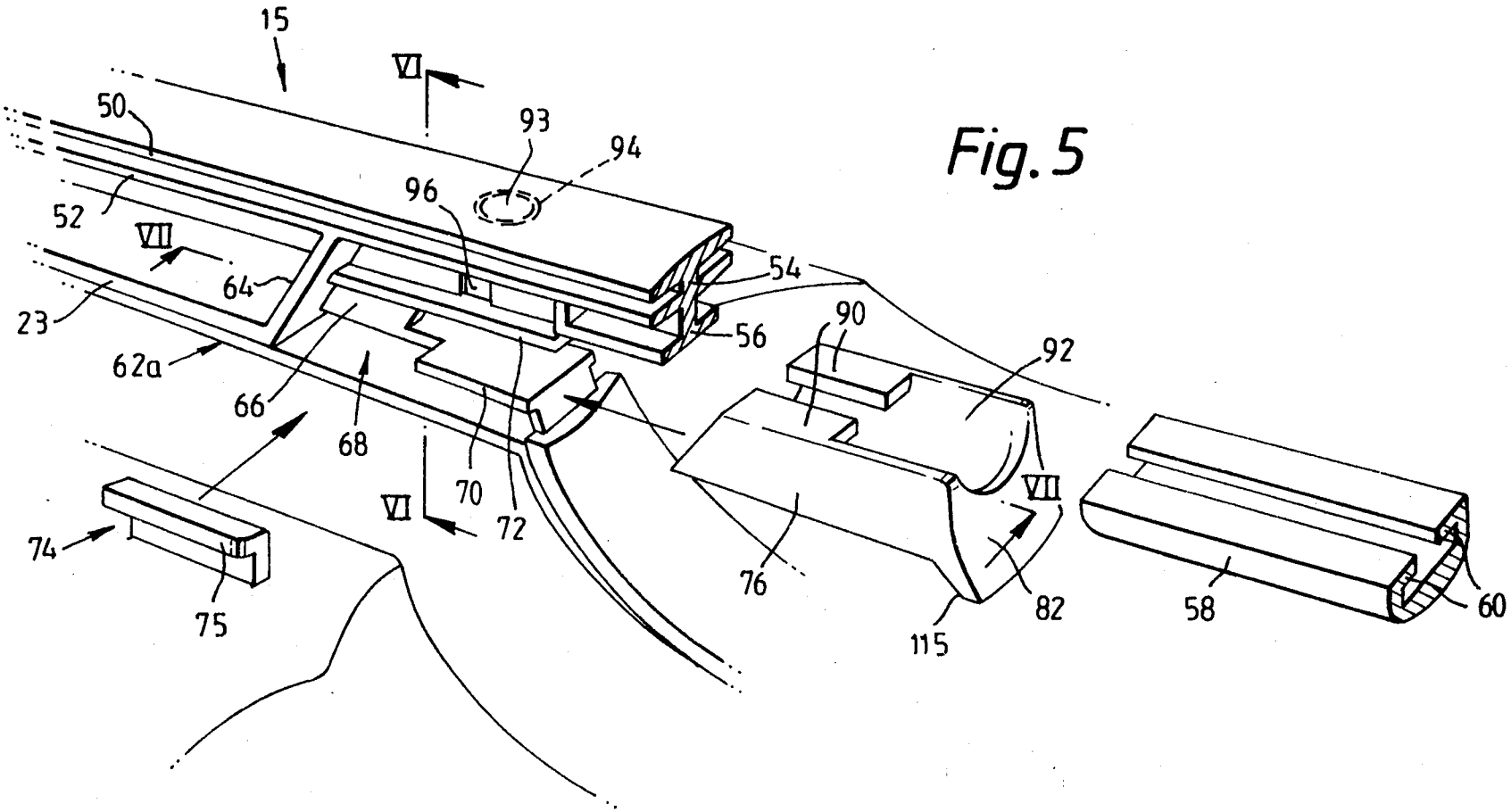
FIG. 5 is an exploded view showing the construction of one of the upper catches.
Figure 6:
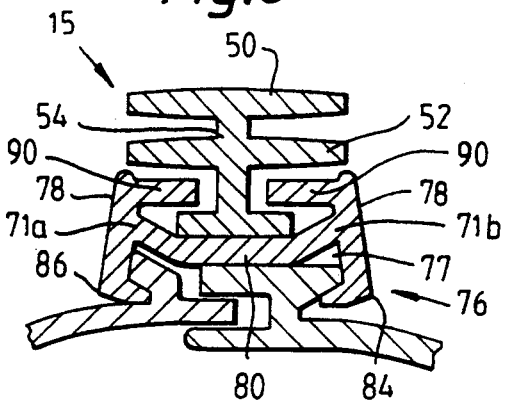
FIG. 6 is a sectional view along the line VI—VI of FIG. 5.
Figure 7:
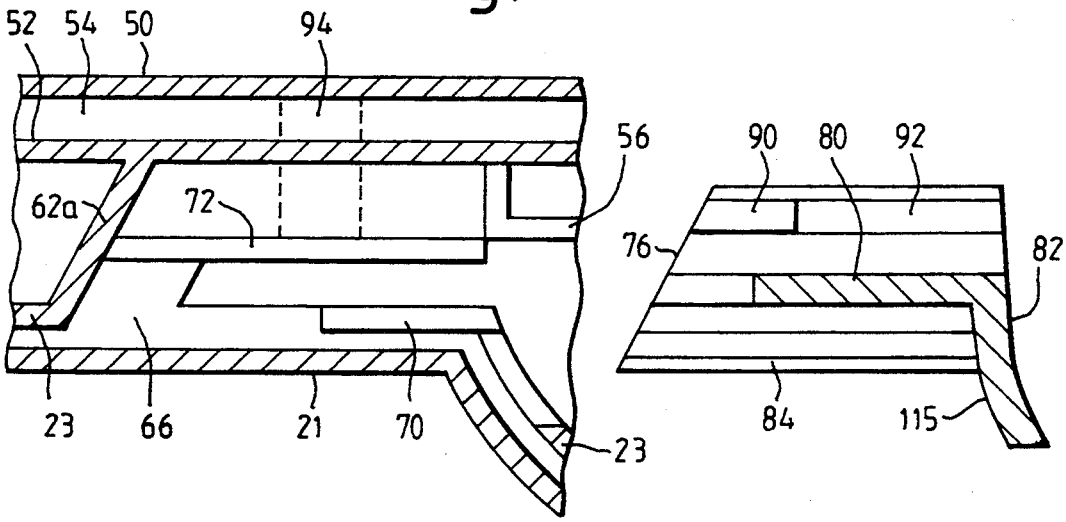
FIG. 7 is a sectional view along the line VII—VII of FIG. 5.

The webs 62*a* and 62*b* also carry the two catches 32*a* and 32*b*, respectively, for the top wall 20 of the case. Referring especially to FIGS. 5 and 6, the web 62*a* includes an end wall 64 inclined away from the strip 15, and a stepped wall 66 extending from the transverse wall 64, along the top wall of the case towards the hand recess. In the region immediately adjacent the end wall, the outer lip 23 of the base shell 12 is cut back to the stepped wall 66 to provide a recess 68 for receiving a catch lip on the lid shell which is described in more detail below. In the region between the catch recess 68 and the arcuate hand recess 28, the outer lip 23 is shortened to provide a first locating flange 70 for a catch member described herinafter. A second locating flange 72 is also formed on the web 62*a* above the first locating flange 70 and below the underside of the strip 15.

A catch lip 74 is formed on the exterior of the lid shell 14 near its rim. The lip 74 is positioned in register with the catch recess 68 on the base shell such that when the case is closed the catch lip 74 is received in the recess 68. The outer edge 75 is turned away from the rim of the lid shell.

A catch member 76 is slidably mounted on the first and second locating flanges 70 and 72 respectively. The catch member 76 is integrally formed of moulded plastics material, and is generally of H-shaped cross section, having two side walls 78, an interior transverse connecting wall 80 and an end wall 82. The interior wall 80 is raised up in regions 71*a* and 71*b* adjacent the side walls 78. The region 71*a* accomodates the shape of the edge 75 of the catch lip 74, as shown in FIG. 6. The other raised-up region 71*b* leaves a gap 77 between the interior wall 80 and the first locating flage 70. The arrangement is such that an indentical catch member can be used for the second catch 32*b*, which is a mirror image of the first catch 32*a*.

The lower ends of the side walls are each formed with short downwardly inclined, inwardly projecting lips 84 and 86. At the end of the catch member 76 remote from the end wall 82, a longitudinal slot 88 is formed in the interior wall 80. Above the slot 88, the upper ends of the side walls are formed with inwardly projecting upper lips 90, which each extend about a third of the distance between the side walls 78. The end wall 82 has an arcuate opening defining a cavity 92 for receiving an end of the rubber strip 58 on the handle 26. The lower end of the end wall projects below the catch member forming a tab 115 which is shaped to match the arcuate shape of the hand recess 28.

As shown in FIG. 6, the upper lips 90 of the catch member fit between the second locating flange 72 and the underside of the handle strip 15. The interior wall 80 fits between the first and second locating flanges 70, 72, respectively. One lower lip 84 engages in the channel 19 at the rear of the outer lip 23, and the other lower lip 86 engages under the first locating flange 70.

Figure 8:
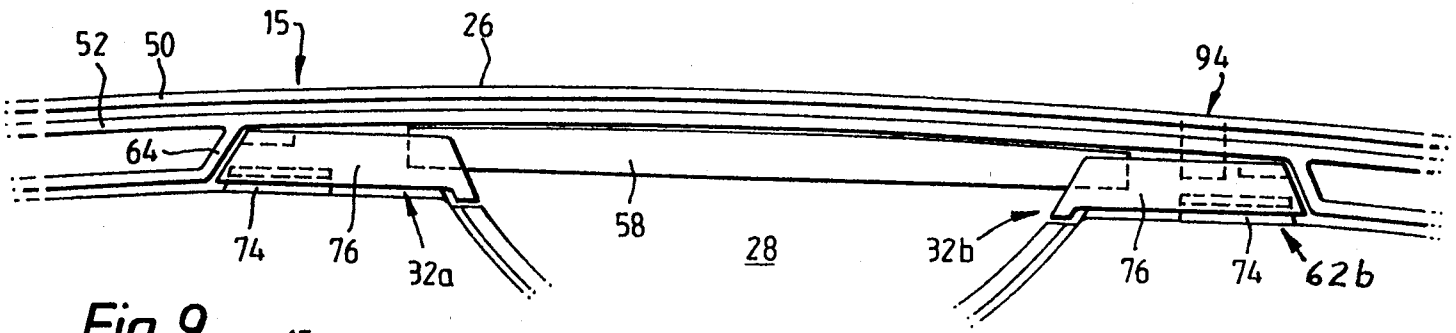
FIG. 8 is a side view showing the latches when locked.
Figure 9:
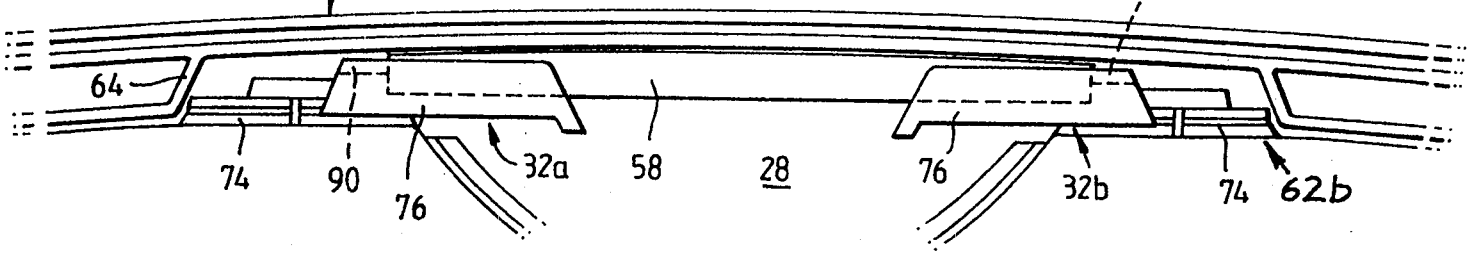
FIG. 9 is a side view showing the latches when unlocked.

The catch member is slidably movable between a locked position in which it abuts the end wall 64 of the web 62*a*, as shown in FIG. 8, and an unlocked position in which it projects into the hand recess 28, as shown in FIG. 9.

Referring especially to FIGS. 6 and 8, when the case is closed and the catch member is moved into the locked position, the lower lip 86 engages over the catch lip 74 on the lid shell 14, thereby holding the catch lip 74 captive in the recess 68 to prevent the lid shell 14 from being opened. A portion of the stepped wall of the web 62*a* is received in the slot 88 in the interior wall 80 of the catch member 76.

Referring to FIG. 9, when the catch member 76 is moved into the unlocked position, the lower lip 86 of the catch member 76 is moved clear of the catch lip 74 of the lid shell 14. The catch lip 74 is thus free to move away from the pocket 68, thereby enabling the lid to be opened.

Figure 10:
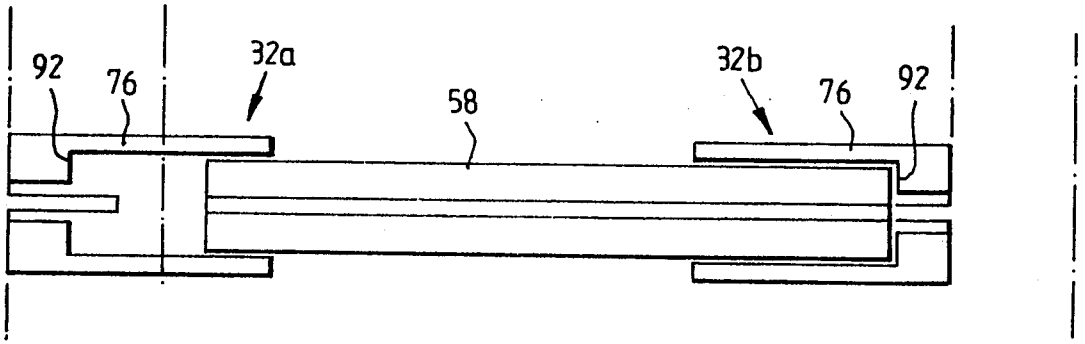
FIG. 10 is a partial view from above showning a detail of the latches.

Referring to FIGS. 8, 9 and 10, the rubber strip 58 on the carry handle 26 is received in the cavity 92 in the catch member. The end of the strip 58 acts as a stop to limit the extent to which the catch member can project into the hand recess 28. When the catch member 76 is moved into the unlocked position, the end of the rubber strip 58 abuts the ends of the upper lips 90 of the catch member.

The construction of the other catch **32*b* is similar to the construction of the catch 32*a* described above except that the catch 32*b* is a mirror image of the catch 32*a*. The catch 32*b* is also formed with a key operated lock 93**.

The design of the lock 93 is illustrated in FIG. 5, although it is to be understood that the lock is only fitted to the second catch **32*b*, and not to the first catch 32*a*. The lock 93 is mounted in a bore 94 in the carry handle 26. The lock 93 has a rotatable abutment surface 96 which can be moved into a position in which it abuts the ends of the upper lips 90 of the catch member 76 when the catch member is in the locked position. This secures the catch member 76** in the locked position.

The catches **32*a* and 32*b* are be assembled before the rubber strip 58 is fitted to the carry handle 26. If the rubber strip 58** has already been fitted, it must be removed.

The flange 56 is narrower than the flange 72 and gap between the upper lips 90 of the catch member 76 for the catch **32*a* is wide enough to enable the catch member to be passed from below over the third flange 56 of the carry handle but not over the flange 72. Once the catch member 76 has been passed over the flange 56 it is slid longitudinally on to the first and second locating flanges 70 and 72, respectively, and into the locked position. This procedure is repeated for the respective catch member 76 of the other catch 32*b*. The rubber strip 58 is then press-fitted into position over the third flange 56 of the carry handle 26**.

If the catch members need to be removed, this can be done by a simple reversal of the above procedure. The rubber strip 58 is first removed from the carry handle 26, and the catch members are slid out towards the centre of the hand recess 28.

Figure 11:
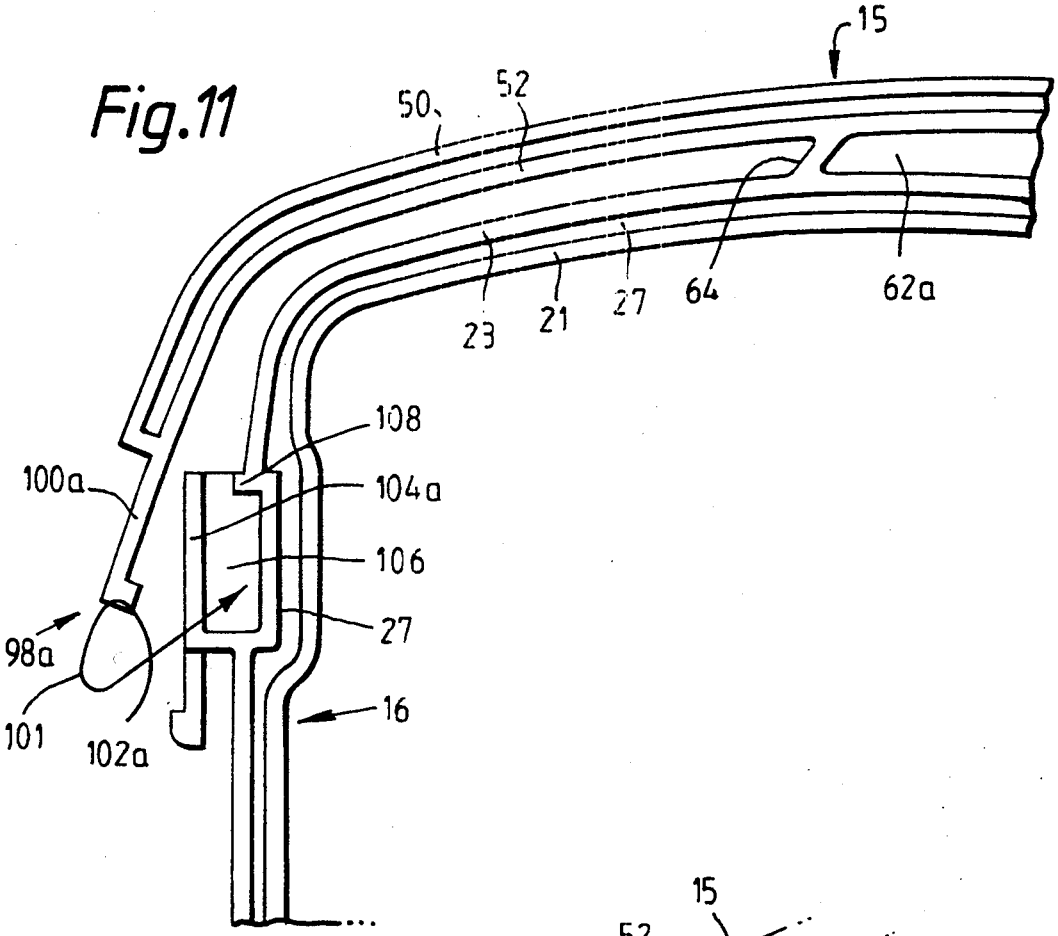
FIG. 11 is a side view showing the construction of the flexible loop handle.
Figure 12:
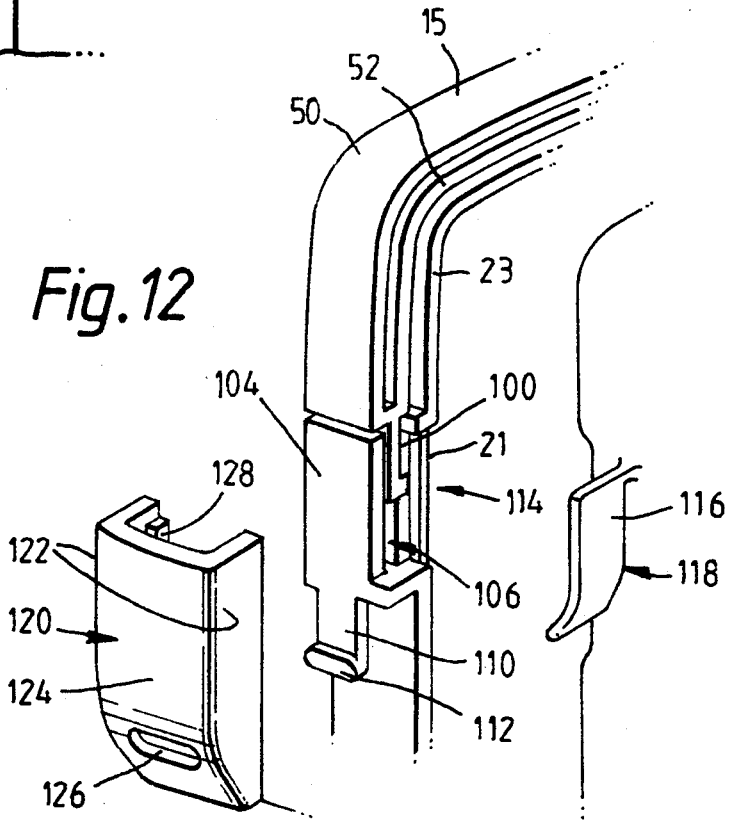
FIG. 12 is a perspective side view showing the construction of one of the side latches.

Referring to FIGS. 11 and 12, the handle strip 15 extends on both sides of the carry handle portion 26, along the top wall 20 of the case, and around the corners between the end walls 24 and the top wall 20. The strip 15 is only joined to the top wall 20 at the webs **62*a* and 62*b*. At each free end 98*a* and 98*b* of the strip 15, the two flanges 50, 52 are reduced to a single tongue 100*a* and 100*b*, respectively, with a tang 102*a*, 102*b***, respectively, at its end of enlarged transverse dimension.

The tongues **100*a* and 100*b* are slidably received in respective housings 104*a* and 104*b* formed one on each end wall 24 of the base shell 12. The housings 104*a* and 104*b* also serve as mountings for side catch members for the side catches 34*a* and 34*b***, respectively, as will be described in more detail hereinafter.

The housing **104*a* is integrally moulded on the edge of the peripheral side wall 16 of the base shell adjacent the outer lip 23. In the region of the housing 104*a*, the outer lip 23 is cut back so that it does not project beyond the height of the inner lip 21. The edge of the housing is substantially flush with the ends of the inner and outer lips 21, 23, respectively. The housing 104*a* defines a cavity 106 which is open along the side adjacent the channel 27 between the inner and outer lips 21, 23, respectively, and which is also open at its end nearest the top wall 20 of the case. A constriction 108 is moulded into the end of the housing to reduce the opening at the end to a transverse slot, through which the tongue portion 100*a* of the strip 15 may pass, but not the tang 102*a* which has a larger transverse dimension than the constriction 108**.

The tongue **100*a* is received in the cavity 106 such that it is slidable longitudinally within the cavity, but the tongue 100*a* cannot be completely withdrawn from the cavity because it is held captive by the tang 102*a* and the constriction 108. The portion of the strip 15 between the web 62*a* and the housing 104*a* forms a flexible loop handle which is movable between a lowered position and a raised position (see FIG. 22). In the lowered position, the tongue 100*a* is pushed fully into the cavity 106, and the strip 15 lies close to the top wall of the shell 12. In the raised position (shown at 170), the tongue 100*a* is withdrawn from the cavity 106 as far as the tang 102*a* will permit, and a portion of the strip 15 is space away from the surface of the shell 12 sufficient to form a loop handle which is suitable for pulling the case by hand on its wheels 11**.

The construction of the housing **104*b* is similar to the construction of the housing 104*a* described above, except that the housing 104*a* is a mirror image because it is formed on the opposite end wall 24. The portion of the strip 15 slidably attached to the housing 104*b* also formes a flexible loop handle similar to that described above. Alternatively the end of the strip 98*b* may be moulded fixed to the housing 104*b***.

FIGS. 12 to 15 show the construction of one of the side catches **34*a*. A flexible cantilever tab 110 extends from the end of the housing 104*a* nearest the bottom wall 22 of the case. The tab 110 has an upstanding button 112. The cut back outer lip 23 of the base shell 12 forms a recess 114 for receiving a catch tab 116 formed on the lid shell. The catch tab 116 is integrally moulded with the lid shell 14, and joined to the shell 14 at its end nearset the top wall 20 of the case. The tab 116 is spaced from the shell 14 by a narrow gap 118, and the tab 116 is curved at its free end towards the edge of the peripheral side wall 18 of the lid shell 14**.

Figure 13:
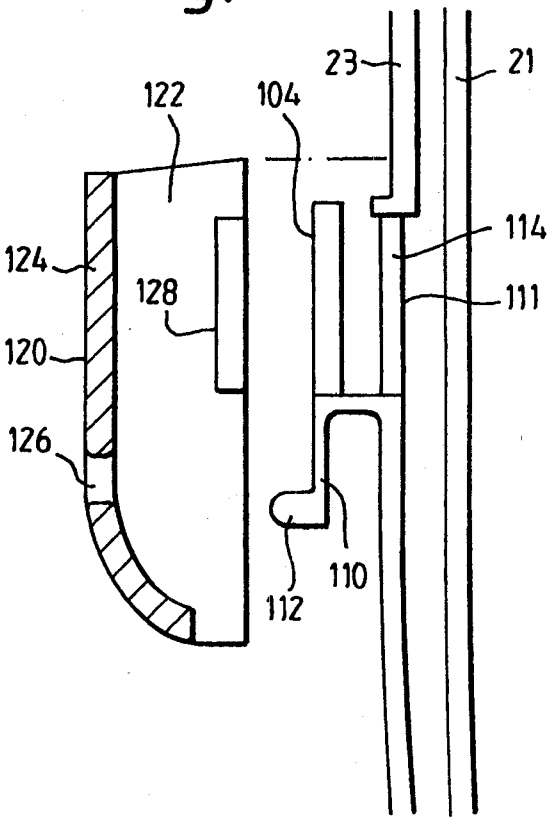
Figure 16:
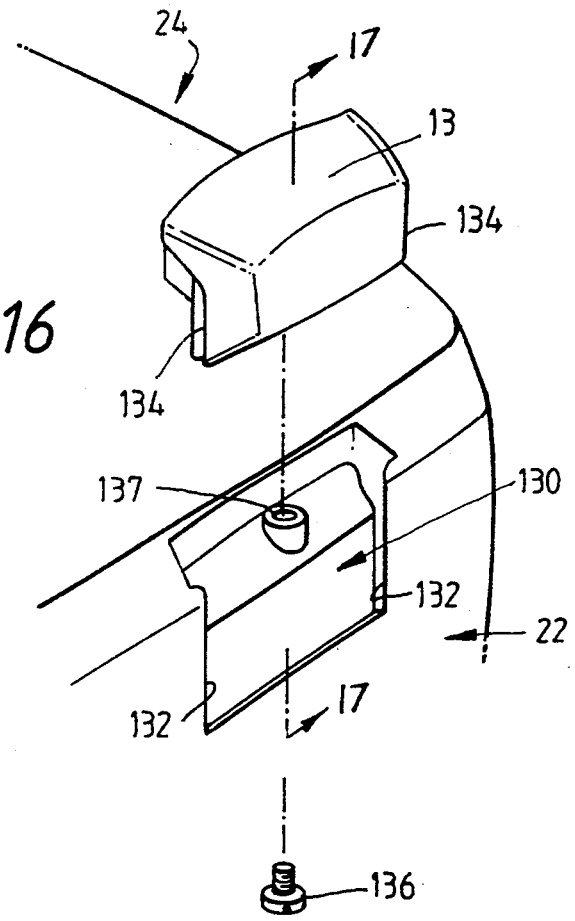
FIG. 16 is a perspective view showing assembly of one of the feet.
Figure 17:
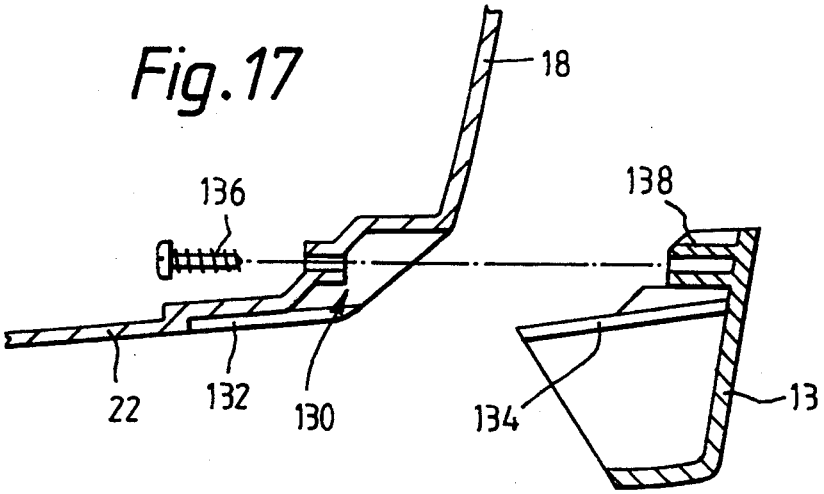
FIG. 17 is sectional view along the line 17—17 of FIG. 16.
Figure 18:
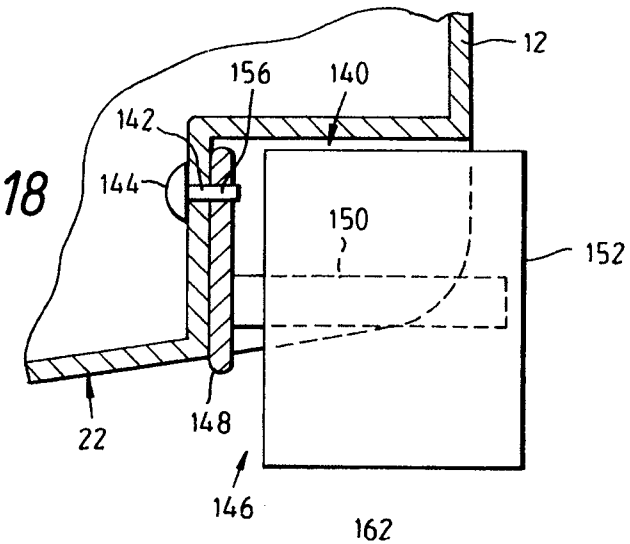
FIG. 18 is a sectional view showing one of the wheels attached to the case.

A slidable side catch member 120 is integrally formed of moulded plastics material. The catch member 120 is generally of U-shaped cross section, having two side walls 122 joined by an outer wall 124. The outer wall 124 is curved inwardly towards the case at its end nearest the bottom wall 22 of the case. A slot-shaped hole 126 is formed in the outer wall 124 near the curved portion for co-operating with the button 112 on the flexible tab 110. The side walls are formed with a pair of opposed short inwardly projecting lips 128. The lips 128 extend for about half the overall length of the catch member 120, and are arranged near the end of the catch member 120 nearest the top wall 20 of the case. Referring to FIG. 13, the lips 128 on the catch member 120 are of about the same length as the length of the pocket 114, and the spacing between the lips is roughly the same as the transverse dimension of the housing **104*a***.

Figure 14:
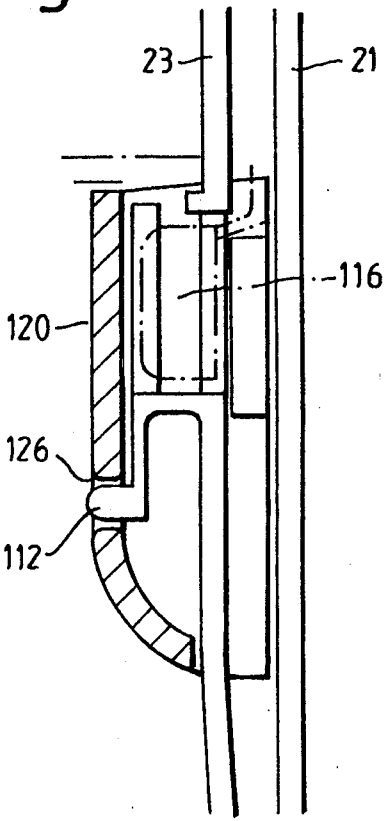

The catch member 120 is fitted to the base shell 12 by hooking one of the lips 128 on the catch member 120 over lip 17 and by aligning the other lip 128 with the recess 114 in housing **104*a*, and pressing the catch member 120 by hand on to the housing 104*a*** so that the lip 128 passes through the recess 114 and the outer wall 124 of the catch member 120 touches, or almost touches, the surface of the housing 104*a*. The button 112 on the flexible tab 110 will be pushed down by the catch member 120 causing the tab 110 to bend towards the surface of the shell 12. The catch member 120 is then slid by hand a short distance towards the bottom wall 22 of the case until the button 112 engages in the hole 126, as shown in FIG. 14. In this position of the catch member 120, the lips 128 of the catch member engage under the outer lip 23, and the rear lip 17, of the base shell 12, thereby securing the catch member 120 to the shell 12, and forming guides for slidable movement.

Figure 15:
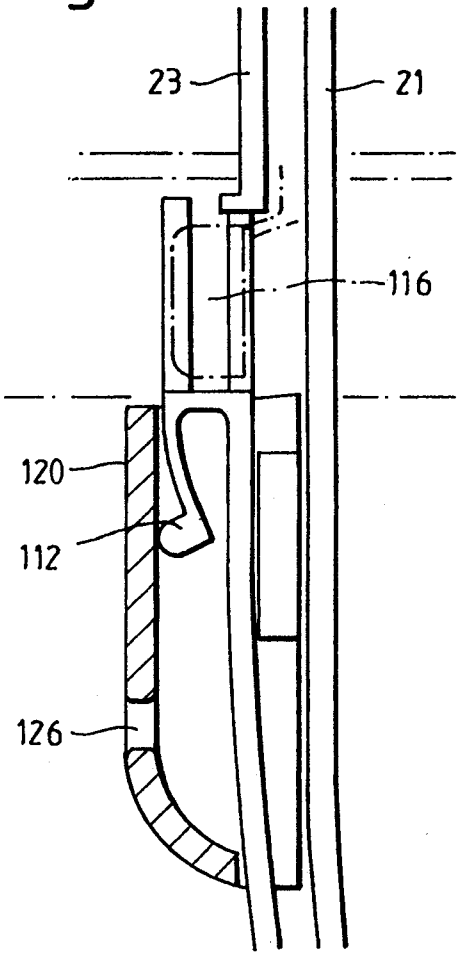
FIGS. 13, 14 and 15 are side sectional views showing how the side latch is assembled.

The side catch member 120 is slidably movable between a locked position in which the button 112 engages in the hole 126 in the catch member, as shown in FIG. 14, and an unlocked position as shown in FIG. 15.

Referring to FIG. 14, when the case is closed and the catch member 120 is moved into the locked position, the side wall 122 of the catch member fits over the catch tab 116 (shown in phantom) on the lid shell 14, thereby holding the catch tab 116 captive in the recess 114 to prevent the lid shell 14 from being opened. The lip 128 on the side wall 122 engages in the narrow gap 118 to firmly secure the catch tab 116 in the catch.

The button 112 engaging in the hole 126 in the catch member acts as a safety catch to prevent the catch member 120 from accidentally being moved out of the locked position. This is desirable because the positioning of the side catch 34*a* on the end wall 24 makes the catch vunerable to being knocked during handling of the case.

Referring to FIG. 15, to unlock the side catch 34*a*, the button 112 is pushed inwardly by pressing it with a finger, and the catch member 120 is slid by hand towards the bottom wall 22 of the case. The catch member 120 is stopped in the unlocked position by the shape of the peripheral side wall 16 of the base shell 12, which abuts surfaces of the catch member 120 to prevent further movement. In the unlocked position, the lip 128 of the catch member 120 is clear of the catch tab 116 (shown in phantom) on the lid shell 14, thereby enabling the catch tab 116 to be lifted out of the pocket 114 to open the lid shell 14.

The catch tab 116 is easily accessible by hand when the catch is open and provides a convenient lifting point to lift the lid shell 14 when opening the case.

When closing the case, the curved end of the catch tab 116 provides a ramp surface to urge the shells 12 and 14 firmly together as the catch member 120 is moved into the locked position.

If the side catch member 120 needs to be removed from the base shell 12, this can be done by a simple reversal of the procedure described above for fitting the catch member 120 to the case.

The construction of the other side catch 34*b* is similar to the construction of the catch 34*a* described above, except that the catch 34*b* is a mirror image of the catch 34*a* because it is mounted on the opposite end wall 24.

Referring to FIGS. 16 to 19, the case also includes a pair of demountable feet 13, and a pair of demountable wheels 11. Recesses are provided at the four corners of the bottom wall 22 of the case for mounting the feet 13 and the wheels 11.

Two shallow recesses 130 are formed one in each of the base shell 12 and the lid shell 14 for mounting the feet 13. The edges of each recess 130 are formed with overhanging lips 132, and the edges of each foot 13 are formed with mating recesses 134 for engaging the lips 132 on the shell. A bore 137 is formed in the shell wall in each recess 130 through which a securing screw 136 can pass from inside the case to secure the foot 13 in the recess 130. Each foot 13 has a hollow moulded barrel 138 into which the screw can be tightened.

To fit each foot 13 to the case, the recesses 134 on the foot are aligned with the lips 132 on the shell, and the foot is pushed into the recess by hand. The locking screw is then inserted through the bore 137 from inside the shell. The locking screw 136 tightened using a suitable tool, to secure the foot in position in the recess 130.

To remove each foot 13, it is merely necessary to undo and remove the locking screw 136, and to slide the foot 13 out from the recess 130.

Two further recesses 140 are formed in the corners at the opposite end of the bottom wall 22 to the recesses 130. The recesses 140 are deeper than the recesses 130. Two bores 142 are provided in one wall of each recess 140 through which securing screws 144 can pass to secure a wheel assembly 146 to the shell.

Each wheel assembly 146 comprises a metal mounting plate 148 carrying an axle 150. A plastics or rubber wheel 152 is mounted for rotation on the axle 150. The mounting plate has two screw threaded holes 156 matching the bores 142 in the recess 140.

Each wheel assembly 146 is secured to the shell by aligning the holes 156 in the mounting plate 148 with the bores 142 in the recess 140. The two securing screws 144 are inserted through the bores 142 from the inside of the case, and tightened in the screw threaded holes 156 in the mounting plate 148.

To remove each wheel assembly 146 from the shells, it is necessary merely to undo the two securing bolts 144.

Figure 19:
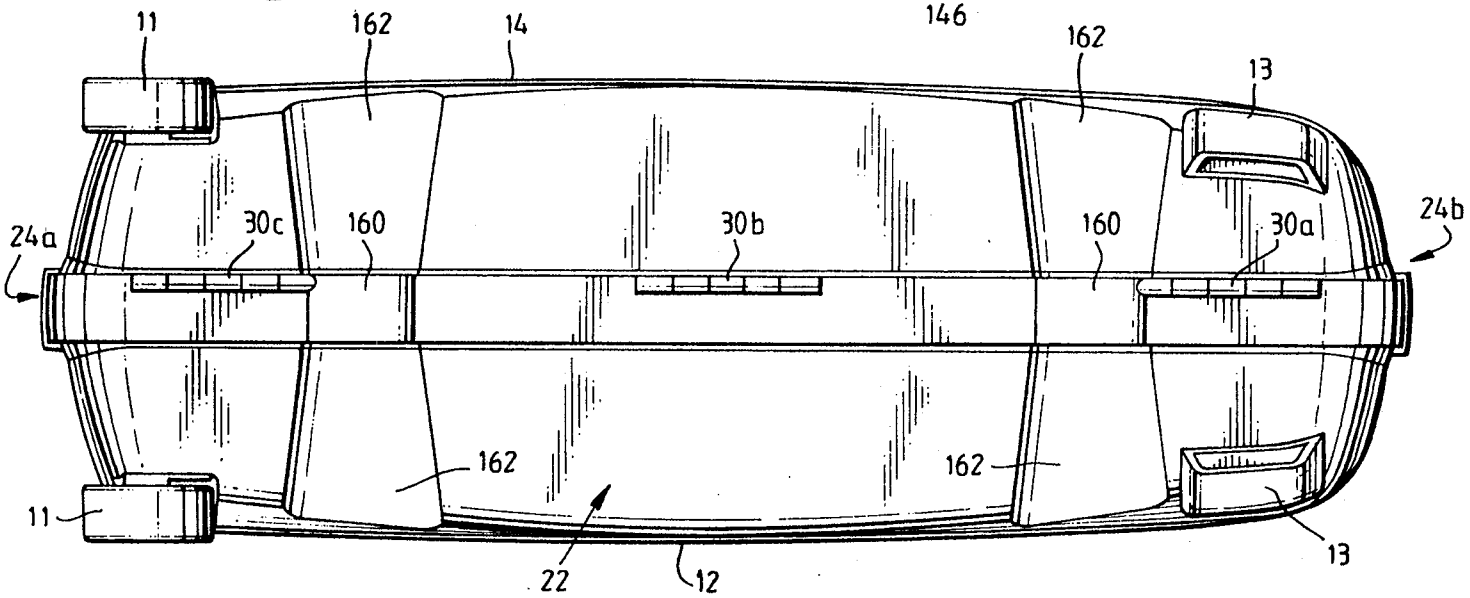
FIG. 19 is a underside view of the case.

As best seen in FIG. 19, the end wall 24*a* adjacent the wheels 11 is slightly wider than the other end wall 24*b* adjacent the feet 13. The bottom wall 22 of the case is therefore slightly wedge-shaped. This non-symmetrical design aids nesting of the shells as described hereinafter.

Figure 20:
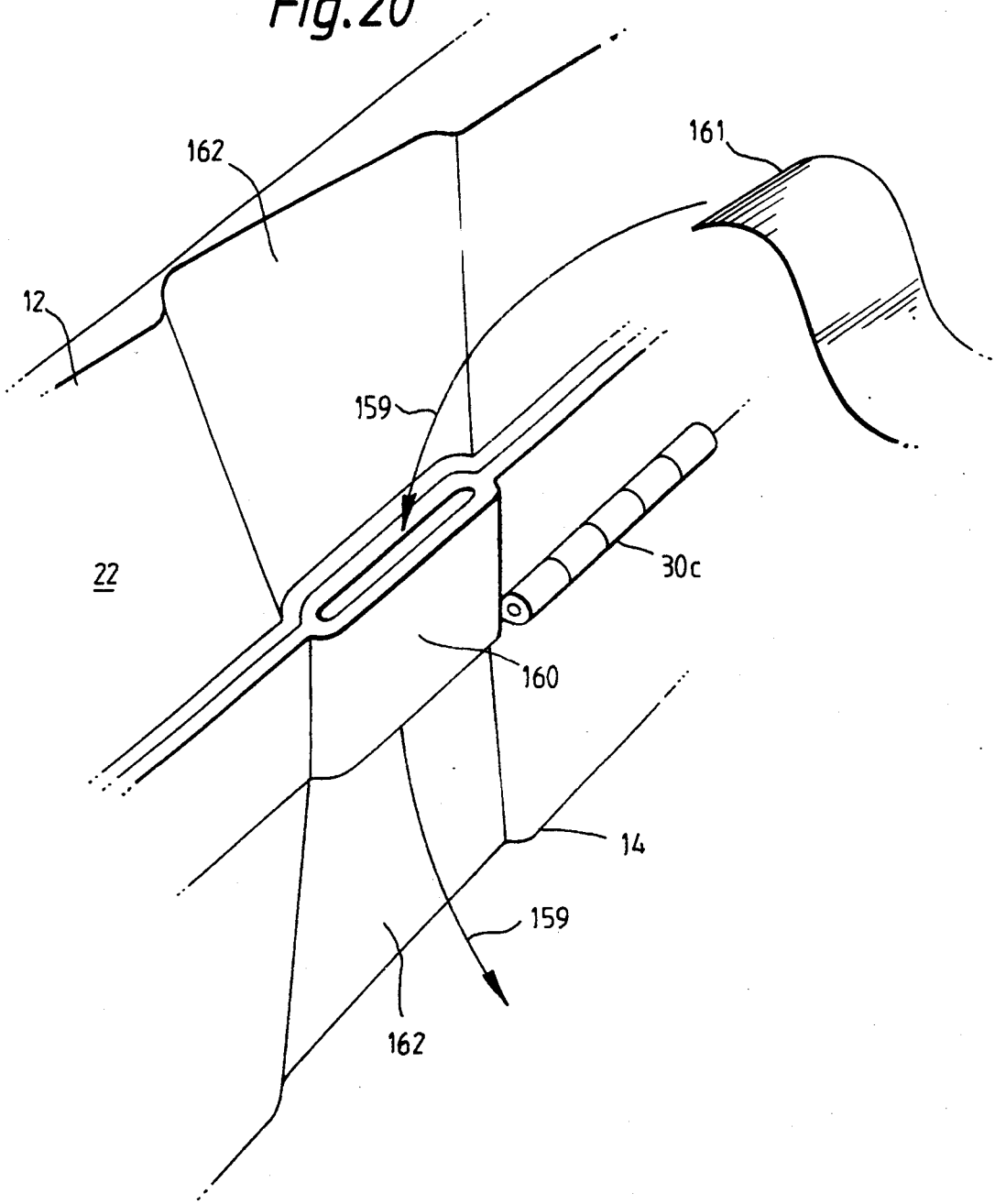
FIG. 20 is a perspective view showing one of the strap attachment loops in more detail.

Referring to FIGS. 19 and 20, two passageways 160 are provided on the bottom wall 22 of the case to enable securing straps 161 to be fitted to the case as shown by the arrows 159. The securing straps may, for example, be straps used for attaching the case to a roof-rack on a motor vehicle. The passageway 160 are integrally formed in the peripheral side wall of the base shell 12. A recessed portion 162 is formed in the base shell 12 and the lid shell 14 in the regions of the bottom wall 22 extending from the loops 160 to the edges of the shells.

Figure 21:
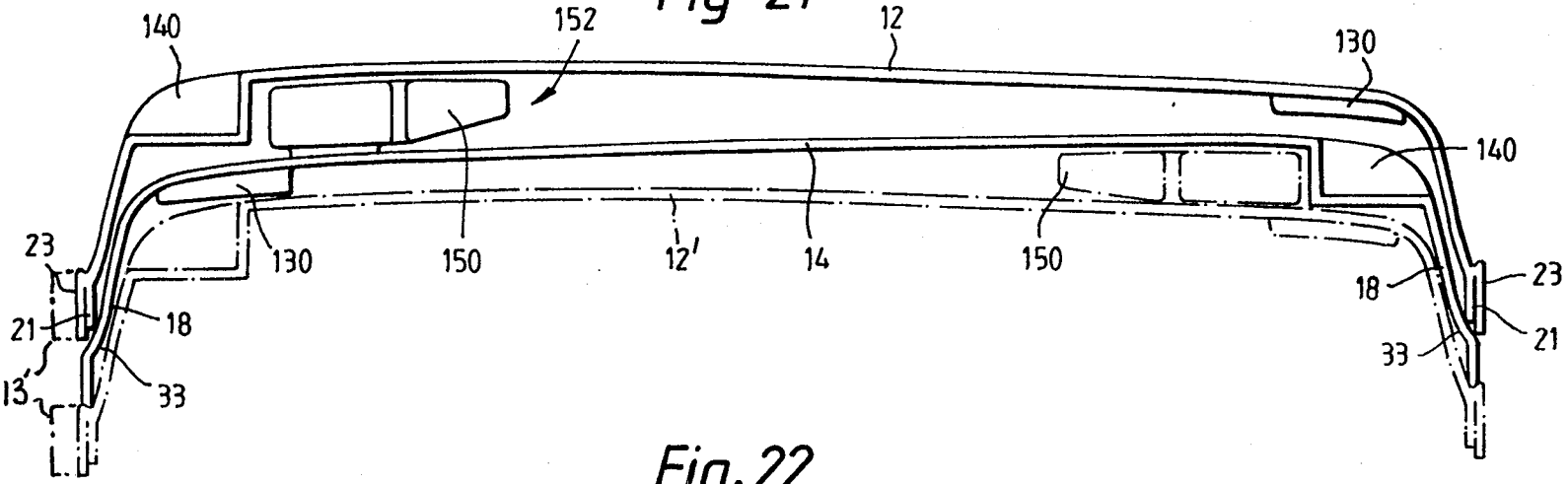
FIG. 21 is a sectional view showing a pack for storing the self-assembly case when it is unassembled.

Referring to FIG. 21, the suitcase 10 is supplied as a self assembly pack, or kit, to be assembled by a person who has bought the kit. The pack comprises the lid shell 14, the base shell 12, the catch members 76*a* and 76*b* for the catches 32*a* and 32*b* respectively on the top wall 20 of the case, the catch members 120*a* and 120*b* for the catches 34*a* and 34*b* on the end walls 24 of the case, a pair of wheel assemblies 146 and two sets of securing screws 144 for the wheel assemblies, a pair of feet 13 and two securing screws 136 for the feet, three hinge pins 44 for the hinges 30*a*, 30*b* and 30*c*, the rubber strip 58 for the carry handle 26, and the elastomeric strip 25.

The pack is arranged with the lid and base shells 12 and 14 nested one within the other. The lid shell 14 is arranged with its peripheral side wall 18 facing downwardly, and the base shell 12 is fitted over the outer surface of the lid shell 14. The remaining fittings of the kit listed above are placed in a packet 150 which is contained in the region 152 between the shells.

The shells 12 and 14 are nested such that the end of the lid shell with the recess 130 for receiving a foot 13 is adjacent the opposite end of the base shell 12 which has the recess 140 for mounting a wheel assembly 146. Similarly, the end of the lid shell 14 with the recess 146 for mounting a wheel assembly 146 is adjacent the opposite end of the base shell 12 which has the recess 140 for receiving a foot 13. Owing to the non-symmetrical design of the end walls 24*a* and 24*b* of the case as described hereinbefore, the height of the region 152 between the shells 12 and 14 is greater one end of the pack than at the other.

The reason for this is to provide a deep region 152 between the shells at one end of the pack, while not increasing the overall height of the pack. A deep region is required to accommodate the fairly deep inwardly projecting recess 140 of the base shell 12 for mounting the wheel assembly 146. The packet 150 containing the demountable fittings is located in the region 152 where there is most room. An alternative position for demountable firings packet 150 is shown in phantom in FIG. 21. Here, the packet 150 will lie inside one of the shells 14 and the other shell 12' (also shown in phantom) of an identical pack with which the first pack is nested.

The shoulder 33 formed in the peripheral side wall 18 of the lid shell provides a clearance into which the inner and outer lips 21 and 23, respectively, of the peripheral side wall 16 of the base shells 14 and 12, respectively to nest together more closely than if the peripheral side walls had been formed as straight sloping walls without the shoulders. The difference in the height of the inner lip 21 and the outer lip 23 also leaves a clearance to enable the shells to nest more closely.

In the pack, the tongues 100 at the ends of the handle strip 15 may be positioned outside the housings 104 for the side catches 34. This may be more convenient during packaging because the tongues 100 will initially be formed outside the housings 104 during moulding of the base shell 12. The insertion of the tongues 100 into the housings 104 would then be a step in the assembly of the case from the kit.

Alternatively, the tongues 100 may be inserted into the housings 104 during manufacture of the base shell 12. A convenient stage for this would be when the shell is being moved from the mould to a jig to allow the plastics to set or cure.

One or more of the hinge pins 44 may conveniently be formed into a tool or wrench so as to serve have a dual purpose as a tool for tightening the securing screws 144 and 136 for mounting the wheels 13 and the the feet 11. For example, the bolts and screws may be formed with a hexagonal Allen-key type hole, and one of the hinge pins 44 can be formed with an end cross section in the form of an Allen-key to match the holes in the bolts and the screws.

To assemble the case, the tongues 100 of the handle strip 15 are twisted sideways and inserted into the housings 104, if this has not already been done prior to packaging. The side catch members 120 and the top catch members 76 are fitted to the base shell, after which the rubber handle strip 58 fitted on to the carry handle 26. The wheel assemblies 146 and the feet 13 are attached to both the lid shell 14 and the base shell 12, possibly with the aid of one of the hinge pins 44 serving as a fastening tool as described above. The hinge pins 44 are inserted to form the hinges, and locked in the locking slots 42. Finally, the elastomeric strip 25 is inserted into the channel 27.

Alternatively, if desired, the catch members may also be assembled prior to packing. The package containing the kit of parts for the case can be wrapped, and stacked or nested with other similar suitcase packages. The overall height of the package is only slightly greater than the height of the deepest shell, which in this embodiment is the base shell 12. With this design, the overall height of two packages nested together will be less than the overall height of a single complete suitcase.

A particular advantage achieved with the design of the preferred embodiment is the overall reduction in shelf space required to keep the case packages in a shop, compared to the space required for a conventional complete suitcase. The density of suitcase packages on the shop shelf can therefore be increased, making the selling of suitcases a much more viable and attractive proposition for the shop owners. This is particularly relevant for large supermarkets, where the high space requirement for conventional suitcases has tended to disuade the supermarkets from offering suitcases for sale.

The increased stacking density of the suitcase packages can also offer advantages in savings in the cost of warehouse storage and transportation.

It will further be appreciated that the suitcase described in the preferred embodiment is intended to be easily dismantled, for example, if the case is to be stored away. The hinge pins 44 can be removed, and the lid shell and the base shell nested one within the other for convenience. To enable the shells to nest properly, the foot and wheel on the inner shell should be removed, and stored with the hinge pins 44. However, it should not be necessary to remove any of the catch members 76 and 120, or to remove the foot and wheel of the outer shell. The nested shells enable the overall space required to store the case to be substantially reduced compared to the space required to store a conventional suitcase. The nested shells may also be significantly easier to handle than a conventional suitcase.

Although in the embodiment described above, the lid shell is nested within the base shell, in other embodiments the base shell may be nested within the lid shell. With this arrangement, there may not be sufficient room between the shells in which to store the pack 150 of demountable fittings. The pack 150 would need to be stored externally of the shells. Referring to FIG. 2, if the base shell is nested with the lid shell, the rim edges of the lid shell 14 can fit in the channel 19 on the rear of the rim of the base shell 12 positively locate the shells. This can help prevent damage or deformation of the shell walls, as explained herein before.

A first alternative packaging scheme is to contain the nested shells and the demountable fittings in a blister pack. The demountable fittings can be contained in a pocket formed in the blister pack.

A second alternative packaging scheme is to contain the nested shells in a hard wall package, such as cardboard or polystyrene. The package could offer structural strength in supporting the shells to ensure that the shells at the bottom of a large stack of case packages will not be damaged by the weight of the stack.

Figure 28:
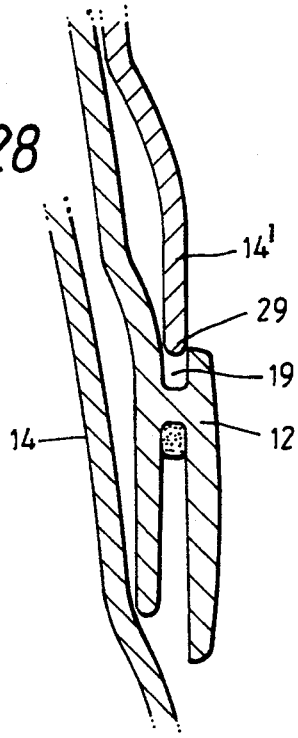
FIG. 28 is a sectional view showing a detail of the pack of FIG. 21 nesting with an identical pack.

Referring to FIGS. 21 and 28, when the pack comprises the lid shell 14 nested with the base shell 12, the channel 19 in the rim of the base shell 12 can provide a recess to positively locate another self-assembly pack which is nested over the base shell 12. The edge 29 of the rim of the lid shell in the other pack can fit into the channel 19. Such an arrangement provides for more stable or secure nesting of the packs, and enables the packs to nest together more closely. With this arrangement, the packaging used for each pack would be designed so as not to prevent the edge 29 of one pack fitting into the channel 19 of the adjacent pack.

Although in the preferred embodiment described above, the handle strip 15 is integrally formed with the base shell, in an alternative embodiment the handle strip may be formed separately from the shells, and secured to one of the shells by means of, for example, screws.

Figure 22:
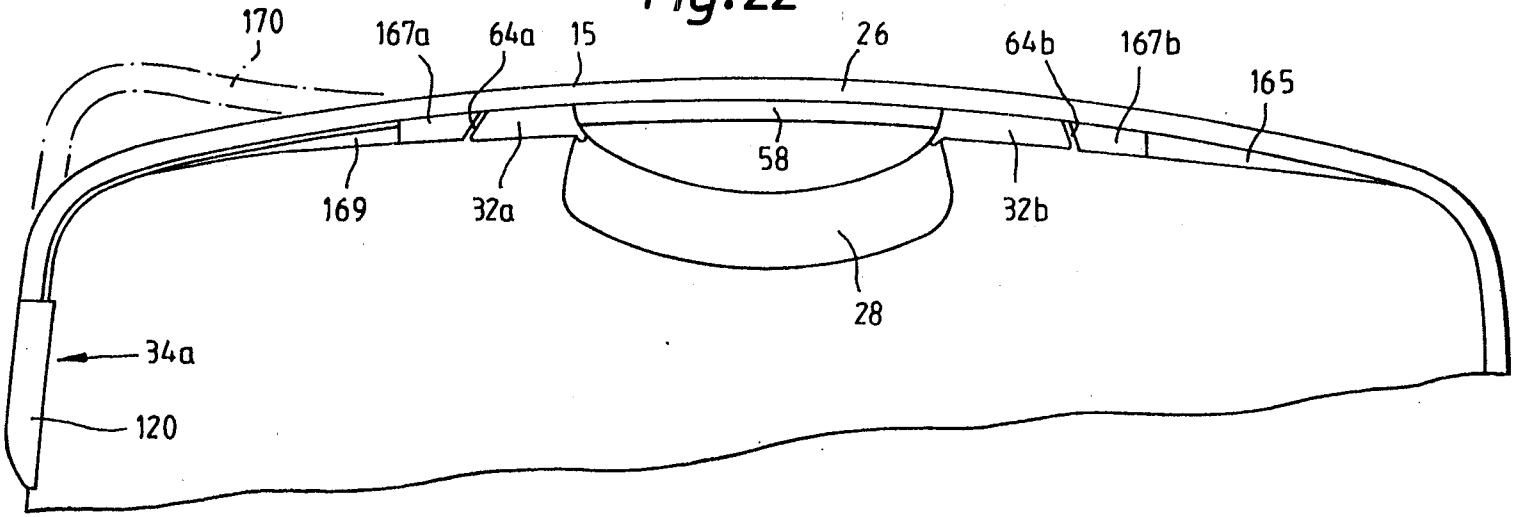
FIG. 22 is a side view showing alternative features of the handle strip in more detail.

Although in the preferred embodiment described above, the handle strip 15 forms a flexible loop handle at both ends of the top wall 20 of the case, in an alternative embodiment, a flexible loop handle might only be provided at the end of the top wall 20 which is diagonally opposite the end of the bottom wall 22 at which the wheels 13 are mounted. Referring to FIG. 22, the fixed end of the handle strip 15 may be attached to the top wall 20 of the case by means of an integrally moulded web 165 extending between the top wall 20 and the underside of the strip 15.

The handle strip 15 may also have passageways 167*a* and 167*b* positioned on each side of the webs 62*a* and 62*b* joining the strip 15 to the base shell 12, through which securing straps may pass in a similar manner to the passageways 160 on the bottom wall 22 of the case. As shown in FIG. 22, one of the passageways 167*b* can be formed by the clearance between the web 62*b* and the end of the web 165. The other passageway 167*a* can be defined by a wall 169 which projects upwardly from the rim of the base shell 12, towards the underside of the handle strip 15. The wall 169 is not attached to the underside of the handle strip 15, and may be spaced from it by around 3 mm.

Although in the preferred embodiment described above, two removable feet 13 are provided on which the case may be stood, in an alternative embodiment, only a single foot might be provided. In combination with the wheels 11, the foot 13 would support the case at three points, as a tripod. This single foot may be removable, as with the feet 13, or it may be integrally formed on the rim of the base shell 12.

Referring to FIG. 21, it can be seen that if the foot 13' (shown in phantom) were to be integrally moulded on the rim of the base shell 12, although it would project from the rim of the shell, it would not interfere with the nesting of the lid and base shells, 12 and 14, in the self-assembly pack. It can also be seen that the foot 13' would not present nesting of the shells if they were swapped, i.e. such that the base shell 12 were nested within the lid shell 14.

Figure 23:
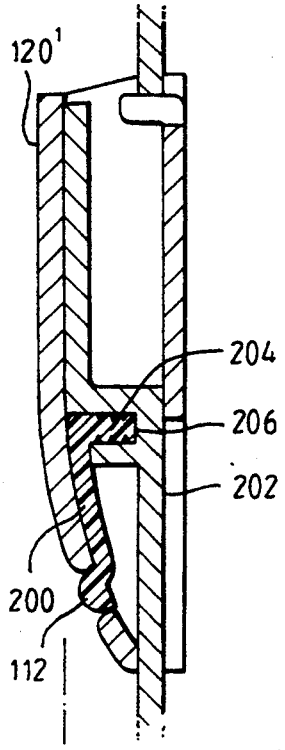
FIG. 23 is a sectional view from the side showing an alternative arrangement for the side catch.
Figure 24:
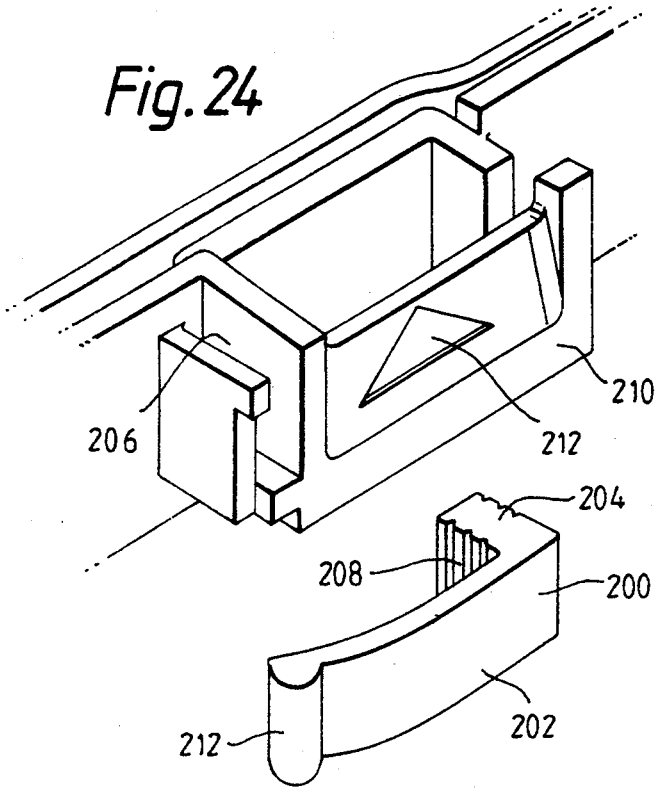
FIG. 24 is a perspective view of the side catch of FIG. 23.

Although in the preferred embodiment described above, the tabs 110 are integrally formed with the housings 104, in an alternative embodiment, the tabs could be made as removable items, and supplied separately in the kit pack. FIGS. 23 and 24 show the detail of the side latches of such an embodiment. Each tab 200 is L shaped, and one limb 202 carries the button 112. The other limb 204 is inserted into a recess 206 formed at the end of the housing 104' nearest the bottom wall of the case. The limb 204 is formed with transverse ribes 208 which grip the inside walls of the recess 206. The tab 200 is held in position by the catch member 120' once the side catch has been assembled. The tab 200 interacts with the catch member 120' in the same way as before, to prevent the side catch from opening accidentally. The tab 200 may be made a different colour from the catch member of the shell to provide a visual contrast.

FIG. 24 also shows a further modification which may be made to the outer wall 210 of the housing 104'. Referring to FIGS. 24 and 12, the outer wall 210 may be embossed with an arrow-head shaped design 212 for indicating the position of the lifting surface provided by the tab 116 on the lid shell, when the case is to be opened. The arrow-head design 212 would be covered up by the catch member 120' when the side catch is locked, but would be visible to indicate the tab for lifting open the lid shell when the side catch is unlocked.

It is also being invisaged that a further alternative to the tabs 110 and 200 would be to incorporate a safety latch in each catch member 120 to prevent accidental unlocking of the side catches 34, instead of using the tabs 110.

Figure 26:
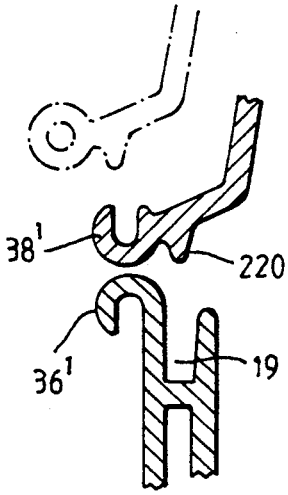
FIG. 26 is a diagramatic view of the arrangement of FIG. 25.
Figure 25:
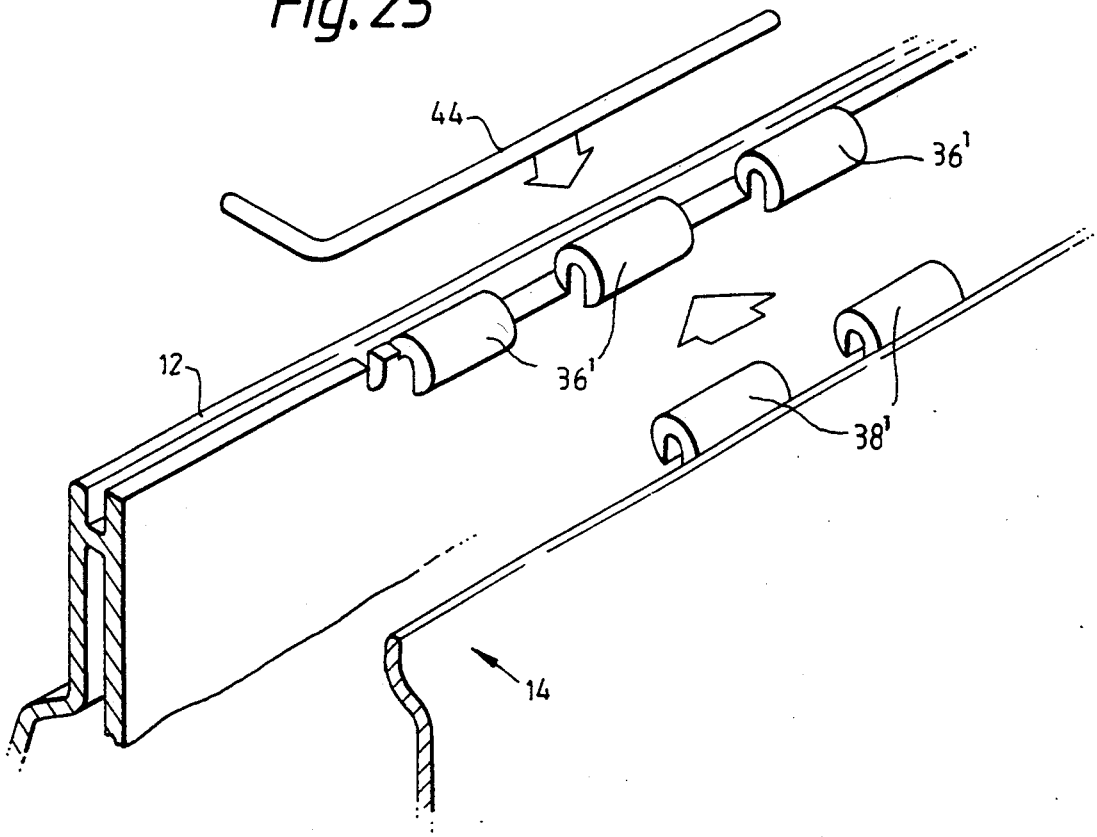
FIG. 25 is a perspective view showing an alternative arrangement for the centre hinge of the case.
Figure 27:
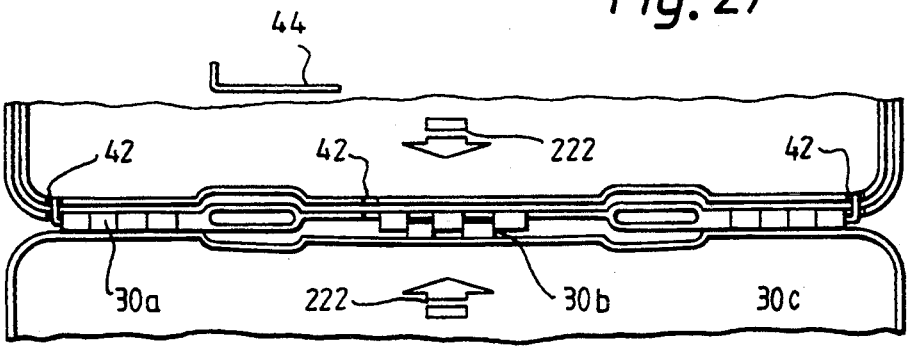
FIG. 27 is a plan view illustrating the assembly of the hinge of FIG. 25.

Although the hinges 30*a, b* and *c* have each been described as butt hinges in which the hinge pin is inserted after the lugs had been lined up, the centre hinge 306 could alternatively be formed as a clip-together hinge. FIGS. 25, 26 and 27 show detail of such an alternative design. In the clip-together hinge 36*b'*, at least one set of lugs 36' and 38' is open along one side so as to lie in the form of hooks which fit over the hinge pin. Such a design of hinge may be preferred for manufacturing reasons, because it is simpler to mould open-hook shaped plastic lugs than cylindrical barrel lugs. However it is preferred that only the centre hinge use this alternative design so as not to reduce the strength of the end hinges.

As shown in the drawings, both sets of lugs 36' and 38' may be formed as hooks, which extend away from the rims of the base and lid shells, 12 and 14, respectively. A projecting rib 220 is formed on the outer surface of the lid shell 14, immediately behind the lugs 38'. In use, when the assembled case is fully opened, the rib 220 engages in the rear channel 19 formed on the rim of the base shell 12, to prevent leteral movement of the lugs 36' and 38' which might otherwise cause the hinge to become loose.

During assembly of the case, the hinge 30*b'* is assembled after assembly of the other two hinges 30*a* and 30*c*. Referring especially to FIG. 27, the adjacent sides of the lid and base shells are pressed towards one another, as shown by the arrows 222, such that the lugs 38' fit in the spaces between the lugs 36'. The L-shaped hinge pin is inserted into the bore formed by lugs, and secured in the slot 42, in the same way as for the other hinges 30*a* and 30*c*. As shown in FIG. 27, when the case is fully opened, the lugs 36' and 38' cover the hinge-pin from view, so that the hinge 30*b* resembles the other hinges 30*a* and 30*c*. This avoids the problem of gaps in the lugs causing the hing pin being visible when the case is open, which might be unsightly.

As shown phantom in FIG. 26, one of the sets of lugs 36' or 38' may be cylindrical barrel lugs, as in the other hinges 30*a* and 30*c*.

It is also envisaged that the L-shaped hinge pin for the clip-together hinge 30*b* could be replaced by shafts integrally moulded with, and extending between, one set of the lugs 36' or 38'. With this arrangement, the other set of lugs would be formed as hooks which fit over, or clip over, the shafts. However, such a design requires a complicated moulding arrangement, and might not be as strong as the clip-together hinge using the L-shaped hinge pin. For this reason, the designs using the separate hinge pin are presently preferred.

Although in the present embodiment, as shown in FIG. 3, the hinges 30*a, b* and *c* are spaced apart and are proud of the rims of the shells, in an alternative embodiment a projecting rib may be formed on one of the shells, extending along the bottom wall of the case, between the hinges. The rib would sence to protect the ends of the hinges from being knocked or banged for example, during rough handling or the case or if the case is pulled on its wheels on rough or uneven ground.

I claim:

1. A pack for constructing a self-assembly luggage case, the pack including a base shell and a lid shell for the case, the shells being nested one within the other, hinge means for connecting the base and lid shells together when the case is assembled, and ground-engaging support means for attachment to an outside surface of the case when the case is assembled to support the case when it is stood on the ground, the ground-engaging support means being so located in the pack as not to prevent the nesting of the shells.

2. A pack according to claim 1, wherein the pack is adapted to nest with other identical packs.

3. A pack according to claim 2, wherein the ground-engaging support means is positioned inside one of the shells so as to lie between it and the other shell of an identical pack with which the pack is nested.

4. A pack according to claim 1 or 2, wherein the ground-engaging support means is positioned in the pack between the two nested shells.

5. A pack according to claim 4, wherein the ground-engaging support means includes a wheel for attachment to the bottom of the case.

6. A pack according to claim 5, wherein the ground-engaging support means includes a foot for attachment to the bottom of the case.

7. A pack according claim 6, wherein the hinge means is located in the pack with the ground-engaging support means.

8. A pack according claim 7, wherein a recess is provided in at least one of the shells for attaching the ground-engaging support means to the bottom of the case when the case is assembled.

9. A pack according to claim 8, wherein interengaging locating means are provided on at least one of the ground-engaging support means and a wall of the recess for locating the ground-engaging support means in the recess, the locating means comprising at least one dovetail lip formed on one of the ground engaging support means and the wall of the recess, and at least one dovetail groove formed on the other of the ground-engaging support means and the wall of the recess for co-operating with the dovetail lip or lips.

10. A pack according to claim 8, wherein the ground-engaging support means is secured in the recess by fixing means.

11. A pack according to claim 8, wherein a mounting plate is attached to the or one of the ground-engaging support means, the mounting plate being secured in the recess when the case is assembled.

12. A pack according to claim 1, wherein the hinge means comprises a hinge pin for insertion into co-operating hinge butts on the shells when the case is assembled.

13. A pack according to claim 12, wherein the hinge pin is substantailly L-shaped.

14. A pack according to claim 12 or 13, wherein a locking means is provided on one of the shells for co-operating with the hinge pin to prevent the pin from being removed from the hinge butts when the assembled case is closed.

15. A pack according to claim 14, wherein the locking means comprises a slot shaped passage formed on one of the shells, one end of the pin being engageable in the passage when the hinge pin is inserted in the hinge butts, the hinge pin being trapped in the passage by the rim of the other shell when the case is closed.

16. A pack for a self-assembly luggage case, the pack comprising a lid shell and a base shell for the case, the shells being nested one within the other, and hinge means for attaching the shells together, the hinge means comprising at least two hinge pins each for insertion within co-operating hinge lugs on a bottom wall of the case when the case is assembled, each of said pins having a transversely extending portion usable as a handle to help the hinge pin to be inserted into the hinge lugs by hand.

17. A pack according to claim 16, wherein each hinge pin is removable from the hinge lugs to disassemble the case, the transversely extending portion being usable as a handle to help each of said pins to be removed by hand.

18. A pack according to claim 16 or 17, wherein each of said pins is substantially L-shaped.

19. A pack according to claim 18, further comprising locating means on one of the shells for co-operating with the hinge pin to locate the hinge pin against axial movement when the hinge pin is inserted within the hinge lugs.

20. A pack according to claim 19, wherein the locating means comprisies means for preventing removal of the pin from the hinge lugs when the assembled case is closed.

21. A pack according to claim 20, wherein the locating means comprises means on one of the shells with which the transversely extending portion of the hinge pin can be engaged.

22. A pack according to claim 21, wherein the locating means comprises a slot in the wall of one of the shells, the transversely extending portion of the hinge pin being engageable in the slot when the hinge pin is inserted in the hinge lugs, and the rim of the other shell trapping the transversely extending portion of the hinge pin in the slot when the case is closed to prevent the hinge pin from being removed.

23. A pack according to claim 18, further comprising ground-engaging support means for attachment to the outside of the case and fixing means for securing the ground-engaging support means, at least one of the hinge pins being adapted to form a tool or wrench for securing the fixing means.

24. A pack for a self-assembly luggage case, the pack comprising a lid shell and a base shell for the case, the shells being nested one within the other, and hinge means for attaching the shells together, the hinge means comprising at least two butt hinges on a bottom wall of the case, each butt hinge comprising a hinge pin, a first set of closely spaced hinge lugs on the base shell each having a passage therethrough to receive the hinge pin, and a second set of closely spaced hinge lugs on the lid shell each having a passage therethrough to receive the hinge pin, when the case is assembled, the first set of hinge lugs being received in spaces between the second set of hinge lugs such that their passages together form a substantially continuous bore into which the hinge pin is inserted.

25. A pack according to claim 24, wherein three butt hinges are provided on the bottom wall of the case.

26. A pack according to claim 24 or 25, wherein each shell has a rim, and the hinge lugs are integrally formed on the rim of the shells.

27. A pack according to claim 25, wherein each hinge pin has a sideways extension portion usable as a handle to enable the hinge pin to be inserted in the hinge lugs by hand.

28. A pack according to claim 27, wherein each hinge pin is subtantially L-shaped.

29. A pack according to claim 24, further comprising locating means on one of the shells, associated with each butt hinge for positively locating the hinge pin when the hinge pin is inserted in the hinge lugs.

30. A luggage case comprising a first shell, a second shell, means for securing the shells together, and a handle strip, the handle strip extending across a top wall of the case and being fixed to the first shell at points on the top wall to define a fixed carry handle, at least one end of the handle strip being slidably attached to the first shell, a portion of the handle strip near said one end being flexible to define a raisable loop handle.

31. A case according to claim 30, wherein the handle stip is intergrally formed with the first shell.

32. A case according to claim 31, wherein the shells are made of plastics material.

33. A case according to claim 30, 31 or 32 wherein said one end comprises a tongue captive but slidable in a recess formed on the first shell.

34. A case according to claim 33, wherein the tongue has an enlarged end, and the recess has a constricted mouth, the enlarged end being too large in a transverse direction to pass through the mouth, whereby the tongue is kept.

35. A case according to any of claim 30, wherein said one end of the handle strip is slidably attached to an end wall of the case, the handle strip extending around the corner between the end wall and the top wall.

36. A case according to claim 30, wherein said one end of the handle strip is housed in a mounting for a catch on the first shell for releasably fastening the shells together.

37. A pack for constructing a self-assembly case, the case having features according to claim 30.

38. A pack according to claim 37, in which there is a cavity formed between the nested shells, the arrangement being such that the separation of the shells is greater at one end of the cavity than at the opposite end.

39. An assembly according to claim 38, wherein each shell has a peripheral side wall, and the peripheral wall of the base shell is deeper along a first side of the shell than along a second side of the shell opposite the first side.

40. An assembly according to claim 38 or 39, wherein each shell has a peripheral wall, and the peripheral wall of the lid shell is deeper along a first side of the shell than along a second side of the shell opposite the first side.

41. An assembly according to claim 40 when dependent on claim 39, wherein the shells are nested with the first side of the lid shell adjacent the second side of the base shell, and the second edge of the lid shell adjacent the first edge of the base shell.

42. An assembly according to claim 38, wherein at least one part of the ground-engaging support means is contained between the shells in a region of the cavity where the shell separation is relatively large.

43. A pack for a self-assembly luggage case, the pack comprising a first shell and a second shell for the case, the first shell having a projecting rim being nested within the second shell, the second shell having a rim, the rim of the second shell being received in a channel in the rear of the projecting rim of the first shell.

44. A pack according to claim 43, wherein the channel extends completing around the first shell on the rear of the projecting rim.

45. An assembly of packs for self-assembly luggage cases, each pack comprising a pack according to claim 43, the packs being nested together to form a stack.

46. An assembly comprising first and second packs for self-assembly luggage cases, each pack being a pack according to claim 43, the first pack being nested within the second pack, and wherein one of the shells of the first pack which is immediately adjacent the second pack is the first shell with the projecting rim with a channel formed in the rear of the rim, and the rim of the shell of the second pack immediately adjacent the first pack being received in the channel.

47. An assembly according to claim 46, wherein the channel extends completely around the projecting rim.

* * * * *